US005541047A

United States Patent [19]

Kashiwagi et al.

[11] Patent Number: 5,541,047

[45] Date of Patent: Jul. 30, 1996

[54] SILVER HALIDE PHOTOGRAPHIC EMULSION, A SILVER HALIDE PHOTOGRAPHIC LIGHT-SENSITIVE MATERIAL AND A METHOD FOR PROCESSING THE SAME

[75] Inventors: Hiroshi Kashiwagi; Hideki Takiguchi, both of Hino, Japan

[73] Assignee: Konica Corporation, Japan

[21] Appl. No.: 354,420

[22] Filed: Dec. 12, 1994

[30] Foreign Application Priority Data

Dec. 16, 1993 [JP] Japan ..... 5-316901

[51] Int. Cl.[6] ..... G03C 1/035; G03C 1/18

[52] U.S. Cl. ..... 430/522; 430/567; 430/569; 430/572; 430/574; 430/585; 430/599; 430/603

[58] Field of Search ..... 430/567, 569, 430/585, 572, 574, 522, 603, 599

[56] References Cited

U.S. PATENT DOCUMENTS

| | | | |
|---|---|---|---|
| 5,296,345 | 3/1994 | Yamashita et al. | 430/603 |
| 5,314,798 | 5/1994 | Brust et al. | 430/567 |
| 5,316,904 | 5/1994 | Parton | 430/584 |
| 5,320,937 | 7/1994 | Jhama | 430/567 |
| 5,350,668 | 9/1994 | Abe et al. | 430/567 |
| 5,358,840 | 10/1994 | Chaffee et al. | 430/567 |

FOREIGN PATENT DOCUMENTS

| | | | |
|---|---|---|---|
| 423693 | 4/1991 | European Pat. Off. | G03C 1/83 |
| 547912 | 6/1993 | European Pat. Off. | G03C 1/005 |
| 0165751 | 7/1986 | Japan | 430/585 |

*Primary Examiner*—Lee C. Wright

*Attorney, Agent, or Firm*—Jordan B. Bierman; Bierman and Muserlian

[57] ABSTRACT

A silver halide photographic light-sensitive material is disclosed, comprising tabular grains having an average aspect ratio of diameter to thickness of 2 or more, having an average overall iodide content of 2 mol % or less, and having a surface phase containing 3 to 20 mol % iodide on the average. The emulsion is spectrally sensitized by adding a sensitizing dye represented by the following formula [I] or [II], formula [I]

formula [II]

7 Claims, 1 Drawing Sheet

SILVER HALIDE PHOTOGRAPHIC EMULSION, A SILVER HALIDE PHOTOGRAPHIC LIGHT-SENSITIVE MATERIAL AND A METHOD FOR PROCESSING THE SAME

FIELD OF THE INVENTION

The present invention relates to a silver halide photographic light-sensitive material which has a high-sensitivity and little dye stain, and which is excellent in the sharpness as well as in the aging stability, and more particularly to a silver halide photographic light-sensitive material for medical radiographic use and a method for processing the same.

BACKGROUND OF THE INVENTION

With regard to the processing of silver halide photographic light-sensitive materials, there has lately been growing a demand for shortening the processing period of time and reducing the discharge of waste processing solutions. In the medical field, for example, there have been sharply increasing medical examinations, including general diagnoses and treatments, attributed to the recently widespread regular medical checkups and complete physical examinations anyone can get hospitalized to undergo, and therefore the number of X-ray films to be radiographed and processed vastly increases, thus leading to a growing demand for the realization of techniques for super-rapidly processing radiographed films and for reducing the amount of waste processing solutions discharged at the time of the processing.

In order to speed up the processing, it is necessary to shorten each of the developing, fixing, washing and drying periods of time, but it results in the increase in the load in each processing step. For example, if the developing time is merely shortened, in the case of a conventional light-sensitive material, it causes the image density to lower, resulting from the sensitivity drop and the deterioration of image gradation. Where the fixing time is shortened, no complete fixation of the silver halide can be achieved to cause the resulting image quality to be degraded. Further, the processing time shortening makes the sensitizing dye's elution incomplete in each of the developing, fixing and washing steps to thus cause the resulting image to be degraded with a residual dye stain. Accordingly, the solution to the above problems requires the speedup of the developing and fixing rates, the reduction in the amount of sensitizing dyes, and the acceleration of the elution and/or decoloration of the sensitizing dye.

On the other hand, the reduction in the discharge amount of waste processing solutions needs to make each processing solution less exhaustible and/or less replenishable, but is accompanied with the same problems as in the above speedup case.

To solve the above problems, EPO506,584, Japanese Patent Publication Open to Public Inspection (hereinafter abbreviated to JP O.P.I.) Nos. 88293/1993 and 93975/1993 disclose techniques which use benzimidazolocarboxycyanines well decolorable as spectral-sensitizing dyes. Also, JP O.P.I. No. 61148/1993 discloses techniques in which oxacarbocyanines and benzimidazolocarboxycyanines as spectral-sensitizing dyes are combinedly used in a specific proportion to a silver halide emulsion having an iodide content of not more than 1 mol %, and the emulsion is further chemically sensitized with a selenium compound and/or a tellurium compound.

However, the use of these disclosed techniques alone, although effective in the residual dye stain improvement, is still not sufficient to satisfy the recent demand levels to various photographic characteristics, particularly to increasing the sensitivity. Further, the above techniques have the disadvantage that the light-sensitive material, when stored in an atmosphere at a high humidity and a high temperature, shows a significant sensitivity drop.

Incidentally, there have recently been disclosed many higher-speed/higher-quality-image-achieving techniques to use tabular silver halide grains, which are described in JP O.P.I. Nos. 111935/1983, 111936/1983, 111937/1983, 113927/1983 and 99433/1984. Further, JP O.P.I. No. 92942/1988 discloses a technique to provide a high silver iodide content core inside the tabular silver halide grain, and JP O.P.I. No. 151618/1988 discloses a technique to use hexagonal tabular silver halide grains for obtaining an increased sensitivity.

In addition to the above, JP O.P.I. Nos. 106746/1988, 183644/1989 and 279237/1989 disclose techniques pertaining to the composition distributions of tabular silver halide grains.

In regard to the crystal structure of the tabular silver halide grain, some techniques about the configuration of grains and parallel twin planes are disclosed; for example, JP O.P.I. No. 131541/1989 discloses a technique to use circular tabular grains for improving the photographic speed and graininess.

JP O.P.I. No. 163451/1988 discloses a technique to use a tabular silver halide grain having parallel two or more twin planes in which the (b/a) ratio of (b) to (a) equals to 5 or more, wherein (a) represents the distance between the twin planes in the tabular silver halide grain and (b) represents the thickness of the grain, said technique being effective in improving both sensitivity and graininess. The publication describes a technique to raise the inter-grain uniformity of the distance between the twin planes to thereby increase the sensitivity and improve the graininess.

WO91/18320 discloses a technique to use a tabular silver halide grain in which the distance between its twin planes is less than 0.012 μm, and describes that it enables to accomplish a high sensitivity.

EP515894A1 describes that raising the sensitivity can be attained by making less than 75% the (111) face proportion to the edge plane of a tabular silver halide grain of which the tabular property defined by (grain diameter )/(grain thickness $)^2$ is 25 or above.

On the other hand, there are also disclosed many techniques for improving tabular silver halide grains by removing their shortcomings therefrom. JP O.P.I. No. 142439/1991 discloses a technique to improve the storage stability in a moist ambience of an emulsion of silver halide grains comprising tabular grains each having an aspect ratio of 3 or more and also having (111) and (100) faces.

The tabular silver halide grain, since its surface area is larger in the same volume than those of silver halide regular crystal grains such as hexahedral and octahedral grains, makes it possible to increase the adsorption amount of a sensitizing dye to its grain surface, and therefore is considered to have the advantage that it is easy to increase its sensitivity and improve its sharpness due to reduction in scattering light.

In fact, however, even when a sensitizing dye in an increased amount in proportion to the surface area of the tabular grain is used, the sensitivity of the grain can not become as much high as expected, and in addition, as the shortcomings of the tabular grain the color stain due to the residual dye and the image quality degradation have now been actualized as the problems in speeding up the processing.

In the case where various water-insoluble photographic additives are introduced into a silver halide emulsion, a method of adding to the silver halide emulsion a solution of such photographic additives dissolved in an organic solvent such as methanol is prevailing. Instead of such the conventional method, an attempt also is made to disperse photographic additives in the presence of a wetting agent and a dispersant without using any organic solvent to prepare an aqueous solution thereof, and the obtained aqueous additives dispersion is added to the silver halide emulsion. Namely, JP O.P.I. No. 110012/1977 describes a method in which a sensitizer is pulverized in the presence of a dispersant (surfactant) providing a certain surface tension in an aqueous phase, and the obtained aqueous dispersion is dehydrated to be dried, and then the product, either as it is or after being dispersed in an aqueous gelatin solution, is added to the silver halide emulsion.

JP O.P.I. No. 102733/1978 describes that a uniform mixture (pasty mixture) of a photographic particulate additive, a dispersant such as sorbitol and a protective colloid such as gelatin is prepared to be made in the noodle form and then dried in a hot air to thereby provide a granulated product, which is then added to a photographic aqueous colloidal composition for coating.

U.S. Pat. No. 4,006,025 describes a method in which a spectral-sensitizing dye is mixed with water to be made in the slurry form, and then uniformly dispersed at a temperature raised to 40°–50° C. in the presence of a surfactant into water, and the dispersion is added to the silver halide emulsion.

These methods are ones for adding photographic additives such as spectral-sensitizing dyes in an aqueous phase without using any organic solvents. However, they have the following problems in practical use. That is, since the aqueous dispersion is pulverized according to a freeze-drying process, and the time required for the adsorption of additives such as spectral sensitizers onto the silver halide grain is prolonged, so that a desired photographic sensitivity can not be obtained within a short spectral and chemical sensitizations period of time, and such the silver halide emulsion, when coated, produces precipitates that tend to cause a coating defect. In addition, the use of a wetting agent or a dispersant for dispersing the additives is liable to destruct the emulsified substance present in the silver halide emulsion; to increase coating troubles in the high-speed coating of the silver halide emulsion or to bring about quality problems such as the poor adhesion trouble of the resulting silver halide photographic light-sensitive material product.

SUMMARY OF THE INVENTION

It is a first object of the present invention to provide a light-sensitive silver halide emulsion comprising tabular silver halide grains having a high sensitivity and excellent storage stability and leaving little of no residual dye stain after being processed.

It is a second object of the invention to provide a silver halide photographic light-sensitive material having a high sensitivity and being capable of forming a photographic image with little or no residual dye stain, excellent in the image sharpness as well as in the storage stability.

It is a third object of the invention to provide a method for processing the above silver halide photographic light-sensitive material.

The above problems can be solved by the invention described below:

(1) A silver halide photographic emulsion comprising tabular grains each having an average iodide content of not more than 2.0 mol %, each with its outermost surface phase having an average iodide content of 4 mol % to 20 mol %, and each having an average aspect ratio of not less than 2.

(2) The silver halide photographic emulsion according to the above (1), wherein said emulsion has at least any one or more of the spectral-sensitizing dyes represented by Formula I and/or Formula II adsorbed thereto so that its J-band between 520nm and 560 nm is formed when subjected to a reflection spectrum measurement.

(3) The silver halide photographic emulsion of the above (2), wherein at least one of said spectral-sensitizing dyes described in the above (2) is added in the form of a solid particle dispersion substantially slightly-soluble in water prepared by being dispersed into an aqueous phase substantially free of an organic solvent and/or a surfactant.

(4) The silver halide photographic emulsion of the above (1), (2) or (3), wherein said emulsion is chemically sensitized with at least one of selenium compounds, tellurium compounds and reductive compounds.

(5) A silver halide photographic light-sensitive material comprising a support having thereon at least one emulsion layer which contains at least one of said silver halide emulsions according to the above (1) to (4).

(6) The silver halide photographic light-sensitive material according to the above (5), wherein said emulsion layer contains a water-soluble dye.

(7) The silver halide photographic light-sensitive material of the above (5), wherein said support and the emulsion layer closest thereto have a non-light-sensitive layer therebetween, wherein said non-light-sensitive layer contains a dye.

(8) The silver halide photographic light-sensitive material of the above (7), wherein said dye is added in the form of a solid particle dispersion.

(9) The silver halide photographic light-sensitive material according to any one of (6), (7) or (8), wherein said light-sensitive material is treated in a process comprising a developing step using a developer solution containing substantially no hardening agent, wherein the overall processing time is 15 seconds to 90 seconds.

DETAILED DESCRIPTION OF THE INVENTION

Figure 1:
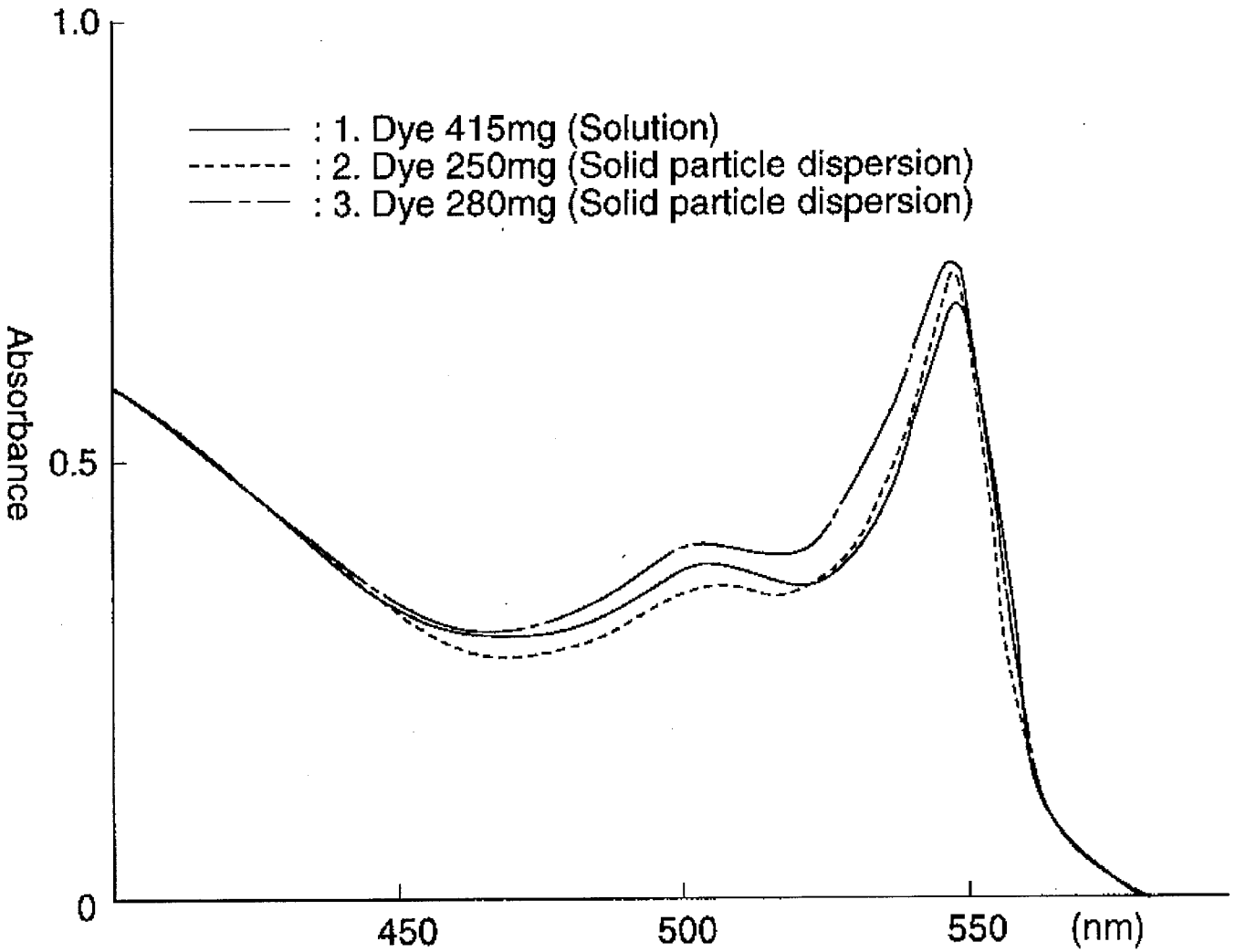
FIG. 1 shows the absorbances of the sensitizing dye in the form of a solution and a solid particle dispersion.

The above spectral-sensitizing dye in the invention includes those capable of contributing to the sensitization of silver halide grains and excludes any organic dyes to be functioned as filter dyes.

In Formula I, $R_1$ and $R_3$ each represent a substituted or unsubstituted alkyl group. The substituted alkyl group includes hydroxymethyl, ethoxycarbonylethyl, ethoxycarbonylmethyl, allyl, benzyl, phenethyl, methoxyethyl, methanesulfonylaminoethyl and 3-oxobutyl groups. The nonsubstituted alkyl group includes lower alkyl groups having 1 to 5 carbon atoms such as methyl, ethyl, propyl and putyl. At least one group represented by either one of $R_1$ and $R_3$ is preferably a non-ethyl group.

$R_2$ and $R_4$ each represent a lower alkyl group having 1 to 5 carbon atoms. At least either one of $R_2$ and $R_4$ represents an alkyl group substituted by a hydrophilic group such as a carboxy or sulfo group. The lower alkyl group includes methyl, ethyl, butyl and trifluoroethyl groups. The hydrophilic group-substituted alkyl group includes carboxymethyl, carboxyethyl, methanesulfonylaminoethyl, sulfobutyl, sulfoethyl, sulfopropyl, sulfopentyl, 6-sulfo-3-oxahexyl, 4-sulfo-3-oxapentyl, 10-sulfo-3,6-dioxadecyl, 6-sulfo-3-thiahexyl, o-sulfobenzyl and p-carboxybenzyl groups.

$V_1$, $V_2$, $V_3$ and $V_4$ each may be any discretionary substituent as long as the sum of its Hammett's values $\sigma p$ does not exceed the limit 1.7. Examples of the substituent include halogen atoms such as fluorine, chlorine, bromine, iodine alkyl groups such as methyl, ethyl, t-butyl; alkoxy groups such as methoxy; alkylthio groups such as methylthio; trifluoromethyl group, cyano group, carboxy group; alkoxycarbonyl groups such as methoxycarbonyl, ethoxycarbonyl; acyl groups such as acetyl; sulfonyl groups such as methanesulfonyl; carbamoyl groups such as carbamoyl, N,N-dimethylcarbamoyl, N-morpholinocarbonyl; sulfamoyl groups such as sulfamoyl, N,N-dimethylsulfamoyl; acetylamino group, and acetyloxy group. Preferably, all of $V_1$, $V_2$, $V_3$ and $V_4$ are not hydrogen atoms or halogen atoms.

$X_1$ represents an ion necessary to neutralize the intramolecular charge. The ion may be either an anion or a cation. Examples of the anion include halogen ions such as the ions of chloride, bromide and iodide; perchlorate ion, ethylsulfate ion, thiocyanate ion, p-toluenesulfonate ion and perfluorate ion. Examples of the cation include hydrogen ion; alkali metal ions such as the ions of lithium, sodium, potassium; alkaline earth metal ions such as the ions of magnesium, calcium; ammonium ion; organic ammonium ions such as the ions of triethylammonium, triethanolammonium, tetramethylammonium; and the like. The preferred among the substituents represented by $V_1$, $V_2$, $V_3$ and $V_4$ are those of which the S value derived from the following Formula A is not more than 1.0, wherein the S value represents bulkiness of the substituent.

$$S=L/\{(B_1+B_2+B_3+B_4)/2\} \quad \text{[Formula A]}$$

wherein L, $B_1$, $B_2$, $B_3$ and $B_4$ represent STERIMOL parameters.

To be concrete, methyl (S=0.815), ethyl (S=0.992), t-butyl (S=0.728), methoxy (S=0.993), methylthio (S=0.982), trifluoromethyl (S=0.697), acetyl (S=0.893), methanesulfonyl (S=0.825), carboxy (S=0.887), carbamoyl (S=0.93), sulfamoyl (S=0.726), fluorine atom (S=0.981), chlorine atom (S=0.978), bromine atom (S=0.982).

The Hammett's $\sigma p$ value, used in the foregoing Formula I, is a substituent constant derived by Hammett et al from the substituent's electronic effect upon the hydrolysis of ethyl benzoate, while the STERIMOL parameter is a value defined by the length of the binding axis found from a projection figure thereof to the benzene nucleus and is described in detail in the Journal of Organic Chemistry vol. 23, 420–427 (1958) Jikken Kagaku Koza (Experimental Chemistry Course) Vol. 14 (Maruzen Publishing Co.); Physical Organic Chemistry (McGraw Hill Book Co., 1940); Drug Design Vol. VII (Academic Press New York, 1976); and Yakubutsu No Kozo Kassei Sokan (Structural Activity Correlations of Chemicals) (Nankodo, 1979).

Examples of the compound represented by the above Formula I in the invention are as follows:

TABLE 1

| Dye | $R_1$ | $R_2$ | $R_3$ | $R_4$ | $X_1$ | $V_1$ | $V_2$ | $V_3$ | $V_4$ |
|---|---|---|---|---|---|---|---|---|---|
| I-1 | $CH_3$ | $(CH_2)_3SO_3H$ | $CH_3$ | $(CH_2)_3SO_3^-$ | $Na^+$ | Cl | H | Cl | H |
| I-2 | $CH_3$ | $(CH_2)_3SO_3H$ | $CH_3$ | $(CH_2)_3SO_3^-$ | $Na^+$ | H | $SCH_3$ | H | $SCH_3$ |
| I-3 | $CH_3$ | $(CH_2)_2SO_3H$ | $CH_3$ | $(CH_2)_2SO_3^-$ | $K^+$ | H | F | H | F |
| I-4 | $CH_3$ | $(CH_2)_4SO_3H$ | $CH_3$ | $(CH_2)_4SO_3^-$ | $Na^+$ | H | CN | H | CN |
| I-5 | $CH_3$ | $(CH_2)_3SO_3^-$ | $CH_3$ | $C_2H_4NHSO_2CH_3$ | — | H | $CONH_2$ | H | $CONH_2$ |
| I-6 | $CH_3$ | $CH_3$ | $CH_3$ | $(CH_2)_3SO_3^-$ | — | $CH_3$ | $CH_3$ | H | $CF_3$ |
| I-7 | $C_2H_4OH$ | $(CH_2)_3SO_3^-$ | $C_2H_4OH$ | $(CH_2)_3SO_3^-$ | $K^+$ | H | $SO_2NH_2$ | H | $SO_2NH_2$ |
| I-8 | $C_2H_5$ | $(CH_2)_3SO_3^-$ | $CH_3$ | $C_2H_5$ | — | H | $CF_3$ | $CH_3$ | $CH_3$ |
| I-9 | $CH_3$ | $(C_2H_4O)_2C_3H_6$-$SO_3^-$ | $CH_3$ | $C_2H_4O)_2C_3H_6SO_3^-$ | $Na^+$ | H | $COCH_3$ | H | $COCH_3$ |
| I-10 | $C_2H_5$ | $(CH_2)_3SO_3^-$ | $CH_3$ | $CH_3$ | — | H | $CF_3$ | H | $CH_3$ |
| I-11 | $C_2H_4COCH_3$ | $CH_2COOH$ | $C_2H_4OCH_3$ | $(CH_2)_2SO_3^-$ | — | H | $CF_3$ | H | $CF_3$ |
| I-12 | $CH_3$ | $(CH_2)_3SO_3^-$ | $CH_3$ | $(CH_2)_3SO_3^-$ | $Na^+$ | H | $SO_2F$ | H | $SO_2F$ |
| I-13 | $CH_3$ | $C_2H_5$ | $CH_3$ | $(CH_2)_3SO_3^-$ | — | H | $SCH_3$ | H | $CF_3$ |
| I-14 | $C_2H_5$ | $C_2H_4NHSO_2CH_3$ | $CH_3$ | $(CH_2)_4SO_3^-$ | — | H | F | H | F |
| I-15 | $CH_3$ | $(CH_2)_3SO_3^-$ | $C_2H_5$ | $CH_2CF_3$ | — | H | $CF_3$ | H | $CF_3$ |
| I-16 | $CH_3$ | $(CH_2)_3SO_3^-$ | $CH_3$ | $(CH_2)_3SO_3^-$ | $Na^+$ | H | $CF_3$ | H | $CF_3$ |
| I-17 | $CH_3$ | m-sulfonium-tolyle | $C_2H_5$ | $(CH_2)_4SO_3^-$ | $Na^+$ | H | $COOCH_3$ | H | $COOCH_3$ |
| I-18 | $C_2H_5$ | $C_2H_5$ | $CH_3$ | $(CH_2)_2SO_3^-$ | — | H | $CF_3$ | H | $CF_3$ |
| I-19 | $CH_3$ | $C_2H_4OC_3H_6SO_3^-$ | $CH_3$ | $C_2H_4OC_3H_6SO_3^-$ | $K^+$ | H | $SO_2CH_3$ | H | $SO_2CH_3$ |
| I-20 | $CH_3$ | $CH_2CF_3$ | $CH_3$ | $(CH_2)_3SO_3^-$ | — | H | $CF_3$ | H | $CF_3$ |
| I-21 | $CH_3$ | $(CH_2)_3SO_3^-$ | $C_2H_5$ | $(CH_2)_3SO_3^-$ | $Na^+$ | H | $SO_2CH_3$ | H | $SO_2CH_3$ |
| I-22 | $CH_3$ | $(CH_2)SO_3H$ | $CH_3$ | $(CH_2)_3SO_3^-$ | $K^+$ | H | $CF_3$ | H | $CF_3$ |
| I-23 | $C_2H_5$ | $CH_2CF_3$ | $CH_3$ | $(CH_2)_3SO_3^-$ | — | H | $CF_3$ | H | $CF_3$ |
| I-24 | $CH_3$ | $CH_2COOH$ | $CH_3$ | $(CH_2)_4SO_3^-$ | — | H | $COCH_3$ | H | $SCH_3$ |
| I-25 | $CH_3$ | $CH_2COOCH_3$ | $CH_3$ | $(CH_2)_3SO_3^-$ | — | H | $CF_3$ | H | $CF_3$ |
| I-26 | $C_2H_5$ | $CH_2COOCH_3$ | $CH_3$ | $(CH_2)_3SO_3^-$ | — | H | $CF_3$ | H | $CF_3$ |
| I-27 | $CH_2COOC_2H_5$ | $(CH_2)_3SO_3^-$ | $CH_3$ | $CH_2COOH$ | — | $CONH_2$ | H | H | $COCH_3$ |
| I-28 | $CH_3$ | $CH_2COOCH_3$ | $C_2H_5$ | $(CH_2)_3SO_3^-$ | — | H | $CF_3$ | H | $CF_3$ |
| I-29 | $CH_3$ | $CH_2COOH$ | $CH_3$ | $CH_2COO^-$ | $Na^+$ | H | $SCH_3$ | H | $SCH_3$ |
| I-30 | $C_2H_5$ | $CH_2CONH_2$ | $CH_3$ | $(CH_2)_3SO_3^-$ | — | H | $CF_3$ | H | $CF_3$ |

TABLE 1-continued

| Dye | $R_1$ | $R_2$ | $R_3$ | $R_4$ | $X_1$ | $V_1$ | $V_2$ | $V_3$ | $V_4$ |
|---|---|---|---|---|---|---|---|---|---|
| I-31 | $C_2H_5$ | $CH_2COOC_2H_5$ | $CH_3$ | $(CH_2)_2SO_3^-$ | — | H | $CF_3$ | H | $CF_3$ |
| I-32 | $C_2H_4OH$ | $(CH_2)_2SO_3^-$ | $C_2H_4OH$ | $(CH_2)SO_3^-$ | $K^+$ | H | H | H | H |
| I-33 | $C_2H_5$ | $CH_2COOC_3H_7$ | $CH_3$ | $(CH_2)_3SO_3^-$ | — | H | $CF_3$ | H | $CF_3$ |
| I-34 | $CH_3$ | $(CH_2)_5SO_3^-$ | $CH_3$ | $(CH_2)_3SO_3^-$ | $Li^+$ | $CH_3$ | Cl | $CH_3$ | Cl |
| I-35 | $C_2H_5$ | $CH_2CON(CH_3)_2$ | $CH_3$ | $(CH_2)_3SO_3^-$ | — | H | $CF_3$ | H | $CF_3$ |
| I-36 | $CH_3$ | m-sulfonium-tolyle | $CH_3$ | $C_2H_4NHSO_2CH_3$ | — | H | $COCH_3$ | H | $COCH_3$ |
| I-37 | $CH_3$ | $CH_2NHC_2H_4$-$SO_3^-$ | $CH_3$ | $CH_2CF_3$ | — | $SCH_3$ | $CF_3$ | $SCH_3$ | $CH_3$ |
| I-38 | $CH_3$ | $(CH_2)_4SO_3^-$ | $C_2H_5$ | $(CH_2)_4SO_3^-$ | $Na^+$ | H | CN | H | CN |
| I-39 | $CH_3$ | $CH_2CN$ | $C_2H_5$ | $(CH_2)_3SO_3^-$ | — | H | $CF_3$ | H | $CH_3$ |
| I-40 | $C_2H_5$ | $(CH_2)_3SO_3^-$ | $CH_3$ | $CH_2COOH$ | — | H | $SO_2CH_3$ | H | $SCH_3$ |
| I-41 | $CH_3$ | $CH_2COCNHC_2$-$H_4SO_3^-$ | $CH_3$ | $C_2H_5$ | — | H | $CF_3$ | H | $CF_3$ |
| I-42 | $CH_3$ | $CH_2CF_3$ | $CH_3$ | $(CH_2)_4SO_3^-$ | — | H | $CF_3$ | H | $CF_3$ |
| I-43 | $CH_3$ | $CH_2COOCH_3$ | $CH_3$ | $(CH_2)_3SO_3^-$ | — | H | COOH | H | COOH |
| I-44 | $C_2H_2CF_3$ | $CH_3$ | $CH_3$ | $C_2H_4CH(CH_3)_3SO_3^-$ | — | $CF_3$ | H | H | $CF_3$ |
| I-45 | $C_2H_4OCH_3$ | $(CH_2)_3SO_3^-$ | $C_2H_4OCH_3$ | $(CH_2)_3SO_3^-$ | $K^+$ | H | $SO_2NH_2$ | H | $SO_2NH_2$ |
| I-46 | $CH_3$ | $CH_2CF_3$ | $CH_3$ | $(CH_2)_2SO_3^-$ | — | H | $CF_3$ | H | $CF_3$ |
| I-47 | $CH_3$ | $CH_2CF_3$ | $CH_3$ | $CH_2CONHCH_2SO_3^-$ | — | H | $CF_3$ | H | $CF_3$ |
| I-48 | $CH_3$ | $(C_2H_4O)_2C_3H_6$-$SO_3^-$ | $CH_3$ | $(C_2H_4O)_2C_3H_6SO_3^-$ | $Na^+$ | H | $COCH_3$ | H | $COCH_3$ |
| I-49 | $CH_2CH{=}CH_2$ | $(CH_2)_2SO_3^-$ | $CH_2CH{=}CH_2$ | $(CH_2)_2SO_3^-$ | $Na^+$ | H | $CONH_2$ | H | $CONH_2$ |
| I-50 | $CH_2CH_2OH$ | $(CH_2)_4SO_3^-$ | $CH_2CH_2OH$ | $(CH_2)_4SO_3^-$ | — | H | $COOCH_3$ | H | $COOCH_3$ |
| I-51 | $CH_3$ | $(CH_2)_2SO_3^-$ | $CH_2H_4OH$ | $(CH_2)_2SO_3^-$ | $Na^+$ | H | F | H | F |
| I-52 | $CH_2CH_2OH$ | $CH_2COOH$ | $C_2H_5$ | $(CH_2)_3SO_3^-$ | — | H | $SO_2CF_3$ | H | $OCH_3$ |
| I-53 | $(C_2H_5O)_2H$ | $(CH_2)_3SO_3^-$ | $CH_3$ | $C_2H_4COCH_3$ | — | H | $SO_2N$ | $CH_3$ | $CH_3$ |
| I-54 | $CH_3$ | $C_2H_4S(CH_2)_4$-$SO_3^-$ | $CH_3$ | $C_2H_4S(CH_2)_4SO_3^-$ | $Na^+$ | H | $SO_2CH_3$ | H | $SO_2CH_3$ |
| I-55 | $C_2H_5$ | $(CH_2)_3SO_3^-$ | $C_2H_5$ | $(CH_2)_3SO_3^-$ | $Na^+$ | H | CN | H | CN |
| I-56 | $C_2H_5$ | $(CH_2)_4SO_3^-$ | $C_2H_5$ | $(CH_2)_4SO_3^-$ | $Na^+$ | H | $COOC_4H_9$ | H | $COOC_4H_9$ |
| I-57 | $C_2H_5$ | $(CH_2)_3SO_3^-$ | $C_2H_5$ | $(CH_2)_4SO_3^-$ | $Na^+$ | Cl | Cl | Cl | Cl |

In addition to the above exemplified compounds, examples of the compound represented by Formula I also include the exemplified compounds II-3, II-4, II-6, II-7, II-8, II-10, II-13, II-14, II-16, II-17, II-18, II-20, II-21 and II-24 to II-44 which all are described in JP O.P.I. No. 9040/1992.

The spectral-sensitizing dye represented by Formula I in the invention can be synthesized according to the methods described in British Patent Nos. 521,165 and 745,546; Belgian Patent No. 615,549; Soviet Patent Nos. 412,218 and 432,166; Japanese Patent Examined Publication (hereinafter abbreviated to JP E.P.) Nos. 7828/1963, 27165/1967, 27166/1967, 13823/1968, 14497/1968, 2530/1969, 27676/1970 and 32740/1970; and Hammer, the Cyanine Dyes-Related Compounds (John Wiley & Sons, New York, 1964).

In the spectral-sensitizing dye of Formula II in the invention, $R_5$ and $R_6$ each represent a substituted or unsubstituted alkyl group, a substituted or unsubstituted alkenyl group or a substituted or unsubstituted aryl group, provided that at least one of $R_5$ and $R_6$ is a sulfoalkyl group or a carboxyalkyl group. $R_7$ represents a hydrogen atom, an alkyl group or an aryl group. $Z_1$ and $Z_2$ each represent a group of nonmetallic atoms necessary to complete a benzene ring or a naphthol ring which each may have a substituent. $X_2$ represents an ion necessary to neutralize the intramolecular charge, and m is an integer of 1 or 2, provided when forming an intramolecular salt, m is 1

The substituted or unsubstituted alkyl group represented by $R_5$ or $R_6$ includes lower alkyl groups such as methyl, ethyl, propyl and butyl groups.

The substituted alkyl group represented by $R_5$ and $R_6$ includes hydroxylalkyl groups such as 2-hydroxyethyl, 4-hydroxybutyl; acetoxyalkyl groups such as 2-acetoxyethyl, 3-acetoxybutyl; carboxyalkyl groups such as 2-carboxyethyl, 3-carboxypropyl, 2-(2-carboxyethoxy)ethyl; and sulfoalkyl groups such as 2-sulfopropyl, 3-sulfobutyl and 2-hydroxy-3-sulfopropyl. The alkenyl group represented by $R_5$ or $R_6$ includes allyl, butinyl, octinyl and oleyl groups. And the aryl group represented by $R_5$ or $R_6$ includes phenyl and carboxyphenyl groups.

Provided, at least one of $R_5$ and $R_6$ is a sulfoalkyl group or a carboxyalkyl group.

Examples of the ion represented by Formula II include chloride ion, bromide ion, iodide ion, thiocyanate ion, sulfate ion, perchlorate ion, p-toluenesulfonate ion, ethyl sulfate ion, sodium ion, potassium ion, magnesium ion, and triethylammonium ion.

$R_7$ represents a hydrogen atom, a lower alkyl group or an aryl group. Examples of the lower alkyl group include methyl, ethyl, propyl and butyl groups. An example of the aryl group is a phenyl group.

$Z_1$ and $Z_2$ each represent a group of non-metallic atoms necessary to complete a substituted or unsubstituted benzene ring, and m is an integer of 1 or 2, provided m is 1 when the compound forms an intramolecular salt.

The following are examples of the spectral-sensitizing dye represented by Formula II usable in the invention.

II-1

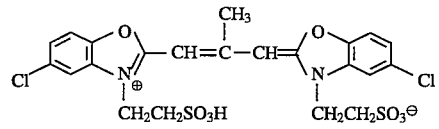

II-2

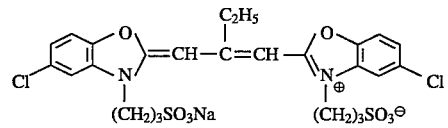

-continued

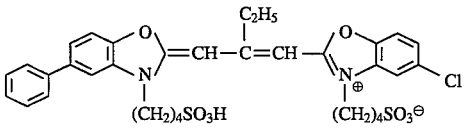

II-3

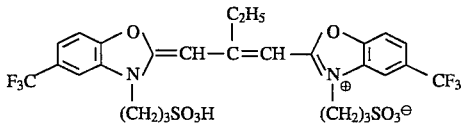

II-4

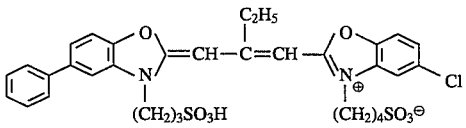

II-5

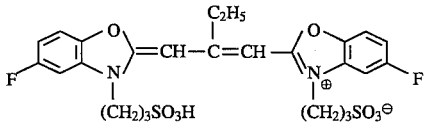

II-6

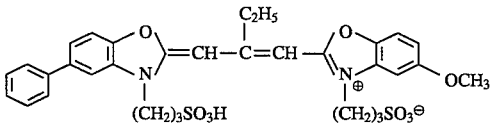

II-7

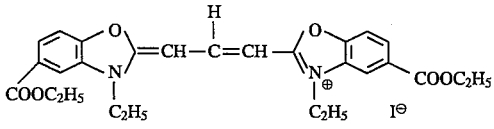

II-8

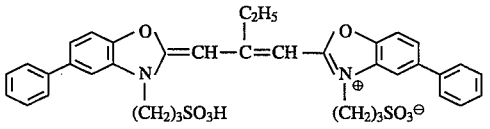

II-9

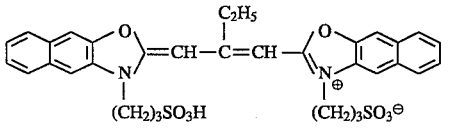

II-10

The above listed sensitizing dyes represented by Formula II usable in the invention can be easily synthesized according to the methods described in F. M. Hammer, 'Heterocyclic Compounds, Cyanine Dyes and Related Compounds, IV, V, VI, pp.89–199, John Wiley & Sons Co. (New York, London) 1964; or D. M. Sturmer, 'Heterocyclic Compounds Special Topics in Heterocyclic Chemistry' VIII, IV, pp. 482–515, John Wiley & Sons Co. (New York London) 1977.

The above Formulas I and II each merely represent a condition of resonance structures and, even when indicated in such the extreme condition that positive charges come into the symmetrical nitrogen atoms, imply being the same substances.

The technique to combinedly use the two different-type spectral-sensitizing dyes of the invention is useful for a light-sensitive material that requires a sensitivity to green light; particularly, remarkably effective in its application to X-ray recording materials utilizing fluorescent screens that emit green light for increasing the recording sensitivity to X-rays; especially effective in radiographic light-sensitive materials for medical use.

In the application to a medical X-ray light-sensitive material utilizing a fluorescent screen emitting green light, there may be used at least either one of the spectral-sensitizing dye of Formula I and that of Formula II, but it is preferred to use them in combination to make their adsorption to the silver halide grain so as to get the grain, when its reflection spectrum is measured, to form J-band in the same wavelength region as that of the green light from the fluorescent screen; that is, it is preferred to normally select spectral-sensitizing dyes to be combined so as to form a J-band within the 520 nm–560 nm wavelength region.

The adding amount of the spectral-sensitizing dyes of Formulas I and II in the invention, although dependent upon the type of the dye used and the silver halide's grain structure, composition, ripening conditions, purposes, uses, etc., is preferably determined so that their monomolecular layer covering rate on the surface of each individual light-sensitive grain in the silver halide emulsion is not less than 40% and not more than 90%, and more preferably 50% to 80%.

In the invention, the monomolecular layer covering rate is determined as an amount relative to the saturated adsorption amount when an adsorption isothermal line is prepared at 50° C. set at the covering rate 100%.

The appropriate amount of the dye per mol of silver halide, although varies according to the overall area of the silver halide grains in the emulsion, is preferably less than 600 mg, and more preferably not more than 450 mg.

In the invention, the spectral-sensitizing dye is added in the form of a solid particulate dispersion; i.e., preferably added in the form of a solid particulate dispersion substantially slightly-soluble in water, which has been prepared by dispersing at least one of the spectral-sensitizing dyes used into an aqueous medium in which any organic solvent and/or any surfactant are substantially not present.

In the invention, that any organic solvent and/or any surfactant are substantially not present implies water containing $10^{-4}$ mol/liter or less of an organic solvent or surfactant, or impurities in a slight amount to such an extent not to adversely affect the silver halide emulsion, and more preferably deionized or distilled water.

In the invention, the solubility of the spectral sensitizer in water is $2\times10^{-4}$ to $4\times10^{-2}$ mol/liter, and more preferably $1\times10^{-3}$ to $4\times10^{-2}$ mol/liter.

In the invention, the solubility of the spectral-sensitizing dye in water was measured according to the following manner: Thirty milliliters of deionized water was put in a 50 ml Erlenmeyer flask, and this, after adding thereto the sensitizer in an amount visually found more than soluble, was stirred by a magnetic stirrer for 10 minutes with its temperature being kept at 27° C. in a thermostat. The suspension was filtered off with a Filter No. 2, produced by Toyo Corp., and the filtrate was properly diluted to be subjected to absorptiometry with use of a spectrophotometer U-3410, manufactured by Hitachi Ltd. Then, from the measurement results the concentration was found in accordance with the Lambert-Beer's law, and further the solubility of the sensitizing dye was determined therefrom.

$$D=\epsilon lc$$

wherein D: absorbance, $\epsilon$: molar absorption coefficient, l: the length of cell for absorptiometry, and c: concentration (mol/liter).

The addition of the spectral-sensitizing dye of the invention may be made during the chemical ripening process, and preferably may be at the start of the chemical ripening. Also, by carrying out the addition of it during the course from the silver halide nucleus-formation until the end of its desalting process, a high-sensitivity silver halide emulsion excellent in the spectral sensitization efficiency can be obtained. Further, at an arbitrary point of time during the course after completion of the desalting process through the chemical ripening process up to right before the emulsion coating time there may be additionally added a different other spectral sensitizer or the same spectral sensitizer as what was added in the preceding process (the nucleus formation-to-desalting completion process).

The spectral-sensitizing dye of the invention may be used in combination with different other spectral-sensitizing dyes such as cyanine dyes, merocyanine dyes, complex cyanine dyes, complex merocyanine dyes, holopolar cyanine dyes, hemicyanine dyes, styryl dyes and hemioxonol dyes. The most preferred among these dyes are cyanine dyes, merocyanine dyes and complex merocyanine dyes. These dyes may be ones having any nuclei generally utilized which include pyrroline nucleus, oxazoline nucleus, thiazoline nucleus, pyrrole nucleus, oxazole nucleus, thiazole nucleus, selenazole nucleus, imidazole nucleus, tetrazole nucleus, pyrridine nucleus, and the like. Other nuclei formed by the fusion of the above nuclei with aliphatic hydrocarbon rings, such as indolenine nucleus, benzindolenine nucleus, indole nucleus, benzoxazole nucleus, naphthooxazole nucleus, benaothiazole nucleus, naphthothiazole nucleus, benzoselenazole nucleus, benzimidazole nucleus, quinoline nucleus and the like may also be applied. These nuclei may be substituted onto carbon atoms.

To the merocyanine dye or complex merocyanine dye may be applied as a ketomethine structure-having nucleus a 5- or 6-member heterocyclic nucleus such as pyrazoline-5-one nucleus, thiohydantoin nucleus, 2-thiooxazolidine-2,4-dione nucleus, thiazoline-2,4-dione nucleus, rhodanine nucleus, thiobarbituric acid nucleus.

These nuclei are described in German Patent No. 929,080; U.S. Pat. Nos. 2,231,658, 2,493,748, 2,503,776, 2,519,001, 2,912,329, 3,655,394, 3,656,959, 3,672,897 and 3,649,217; British Patent No. 1,242,588; and JP E.P. No. 14030/1969.

Together with these spectral-sensitizing dyes there may be incorporated into the emulsion layer a dye which has no spectral sensitization effect or a substance which does substantially not absorb visible lights but shows a supersensitization effect.

The selenium sensitizer used for chemical sensitization in the invention includes a large variety of selenium compounds, which are described in U.S. Pat. Nos. 1,574,944, 1,602,592 and 1,623,499; and JP O.P.I. Nos. 0046/1985, 25832/1992, 109240/1992 and 147250/1992. Useful examples of the selenium sensitizer include colloidal selenium metal; isoselenocyanates such as allylisoselenocyanate; selenoureas such as N,N-dimethylselenourea, N,N,N'-triethylselenourea, N,N,N'-trimethyl-N'-heptafluoroselenourea, N,N,N'-trimethyl-N'-heptafluoropropylcarbonylselenourea, N,N,N'-trimethyl-N'-4-nitrophenylcarbonylselenourea; selenoketones such as selenoacetone, selenoacetophenone; selenoamides such as selenoacetamide, N,N-dimethylselenobenzamide; selenocarboxylic acids and selenoesters such as 2-selenopropionic acid, methyl-3-selenobutyrate; selenophosphates such as tri-p-triselenophosphate; selenides such as diethyl selenide and diethyl diselenide. The most preferred selenium sensitizers are selenoures, selenoamides and selenoketones.

Examples of the techniques for using these selenium sensitizers are disclosed in the following publications: U.S. Pat. Nos. 1,574,944, 1,602,592, 1,623,499, 3,297,446, 3,297,447, 3,320,069, 3,408,196, 3,408,197, 3,442,653, 3,420,670 and 3,591,385; French Patent Nos. 2,693,038 and 2,093,209; JP E.P. Nos. 34491/1977, 34492/1977, 295/1978 and 22090/1982; JP O.P.I. Nos. 180536/1984, 185330/1984, 181337/1984, 187338/1984, 192241/1984, 150046/1985, 151637/1985, 246738/1986, 4221/1991, 24537/1991, 111838/1991, 116132/1991, 148648/1991, 237450/1991, 16838/1992, 25832/1992, 32831/1992, 96059/1992, 109240/1992, 140738/1992, 140739/1992, 147250/1992, 149437/1992, 184331/1992, 190225/1992, 191729/1992 and 195035/1992; British Patent Nos. 255,846 and 861,984; and H. E. Spencer, the Journal of Photographic Science, vol. 31, pp. 158–169 (1983).

The using amount of the selenium sensitizer depends on the compound used, silver halide grains and chemically sensitizing conditions, but is normally $10^{-8}$ to $10^{-4}$ mol per mol of silver halide. The incorporation of the selenium sensitizer into the emulsion may be carried out by any one of appropriate methods according to the nature of the selenium compound used, such as by adding in the form of a solution of it dissolved in water or in a single organic solvent or a mixture of organic solvents such as methanol and ethanol; by adding in the form of a previously prepared mixture of it with an aqueous gelatin solution; or by adding in the form of an emulsified dispersion of it with an organic solvent-soluble polymer, the method disclosed in JP O.P.I. No. 140739/1992.

The chemical ripening temperature in the case of using the selenium sensitizer is preferably in the range of 40° to 90° C., and more preferably 45° C. to 80° C., and pH and pAg in the process are preferably 4 to 9 and 6 to 9.5, respectively.

The tellurium sensitizer used in the chemical sensitization of the invention and the method for the sensitization with the same are disclosed in U.S. Pat. Nos. 1,625,499, 5,520,069, 5,772,051, 5,551,289 and 5,655,594; British Patent Nos. 255,211, 1,121,496, 1,295,462 and 1,596,696; Canadian Patent No. 800,958; and JP O.P.I. Nos. 204640/1992 and 333043/1992. Useful examples of the tellurium sensitizer include telluroureas such as N,N-dimethyl-tellurourea, tetramethyltellurourea, N-carboxyethyl-N,N'-dimethyl-tellurourea, N,N'-di-methyl-N'-phenyl-tellurourea; phosphinetellurides such as tributylphosphinetellurides, tricyclohexylphosphinetelluride, triisopropylphosphinetelluride, butyl-diisopropylphosphinetelluride, dibutylphenylphosphinetelluride; telluroamides such as telluroacetamide, N,N-dimethyltellurobenzamide; telluroketones, telluroesters, isotellurocyanates, and the like.

Techniques for using these tellurium sensitizers follow those for the foregoing selenium sensitizers.

In the invention, it is preferred to use a reduction sensitizer in combination. The reduction sensitizer is preferably added in the course of growing the silver halide grain. The method of adding the reduction sensitizer during the grain growth includes not only a method of adding the sensitizer to the grain while its growth is going on but also a method of adding it to the grain while its growth is suspended and then resuming the growth of the reduction-sensitized silver halide grain.

In the invention, the silver halide grain may be sensitized with a selenium compound and a tellurium compound, but can also be sensitized further with a sulfur compound and a noblemetallic salt such as a gold salt. The reduction sensitization may of course be used, and furthermore, the sensitization may be carried out by combinedly using these sensitization methods.

As the sulfur sensitizer applicable to the invention there may be used those as described in U.S. Pat. Nos. 1,574,944, 2,410,689, 2,278,947, 2,728,668, 3,501,313 and 3,656,955; West German Patent (OLS) No. 1,422,869; and JP O.P.I. Nos. 24937/1981 and 45016/1980, and useful examples of the sulfur sensitizer include thiourea derivatives such as 1,3-diphenylthiourea, triethylthiourea, 1-ethyl-3-(2-thiazolyl)thiourea; rhodanine derivatives, dithiacarbamic acids, polysulfide organic compounds, and sulfur element. The sulfur element is preferably α-sulfur belonging to rhombic system.

The gold sensitizer includes chloroauric acid, gold thiosulfate, gold thiocyanate, thioureas, rhodanines, and gold complexes with various other compounds.

The using amount of the sulfur sensitizer or gold sensitizer, although different according to the type of the silver halide emulsion used, the kind of the compound used, the ripening conditions applied, etc., is preferably $1\times10^{-4}$ mol to $1\times10^{-9}$ mol, and more preferably $1\times10^{-5}$ mol to $1\times10^{-8}$ mol per mol of silver halide.

The sulfur sensitizer or gold sensitizer in the invention may be added either in the form of a solution of it dissolved in water, alcohol or other inorganic or organic solvent or in the form of an emulsified dispersion of it dispersed by use of a water-insoluble solvent or a medium such as gelatin.

In the invention, the sulfur sensitization and gold sensitization of the silver halide may be conducted either simultaneously or separately stepwise. In the latter case, good results can be obtained when the gold sensitization is conducted after nearly completion of or in the midst of the sulfur sensitization.

The reduction sensitization in the invention is conducted by adding a reducing agent and/or a water-soluble silver salt during the growth of the silver halide grains of the silver halide emulsion.

Useful examples of the reducing agent include thiourea dioxide, ascorbic acid and derivatives thereof. Other preferred examples of the reducing agent include polyamines such as hydrazine and diethylenetriamine dimethylamine boranes, sulfites, and the like.

The adding amount of the reducing agent is preferably changed according to the type of the reducing agent used, the grain diameter, composition and crystal habit of the silver halide grains, and ambient conditions such as the temperature, pH and pAg of the reaction system, and the like; for example, in the case of thiourea dioxide, when used in an amount of about 0.01 to 2 mg per mol of silver as a standard, satisfactory results can be obtained, while in ascorbic acid, its preferable amount is about 50 mg to 2 g per mol of silver halide.

The reduction sensitization is conducted preferably for 10 to 200 minutes at a temperature of about 40° to 70° C., pH of about 5 to 11, and pAg of about 1 to 10, wherein the pAg value is logarithmic reciprocal of Ag+ ion concentration.

The water-soluble silver salt is preferably silver nitrate. By the addition of the water-soluble silver salt, the silver halide is subjected to silver ripening, a kind of the reduction sensitization technique. pAg in the silver ripening is preferably 1 to 6, more preferably 2 to 4. Conditions of temperature, pH and time are preferably in the same ranges as defined for the above reduction sensitization. As the stabilizer for the silver halide photographic emulsion containing the reduction-sensitized silver halide grains of the invention there may be used general stabilizers hereinafter described, but these stabilizers can often provide good results when used in combination with appropriate ones of the antioxidants disclosed in JP O.P.I. No. 82831/1982 and/or the thiosulfones described in V. S. Gahler, Zeitshrift fur wissenschaftliche Photographie Bd. 63, 133 (1969) and JP O.P.I. No. 1019/1979. The addition of these compounds may be conducted at any point of time during the emulsion manufacturing process between the crystal growth and the preparation step immediately before the emulsion coating.

As the silver halide grain of the silver halide emulsion of the invention, grains of silver halide such as silver iodobromide, silver iodochloride, silver chloroiodobromide and the like may be used discretionarily. The most preferred are silver iodobromide and silver chloroiodobromide.

The silver halide grain suitably usable in the invention is explained.

The tabular silver halide grain used in the invention is classified as twin crystallographically. The twin is a silver halide crystal having one or more twin planes with a single grain. The classification of twin crystal configurations is described in detail in Klein and Moisar, Photographisches Korrespondenz, vol. 99, p. 99; vol. 100, p. 57.

The tabular silver halide grain used in the invention is one having mainly an even number of parallel twin planes; these twin planes may or may not be parallel with one another, but preferably one having two twin planes.

In the tabular silver halide grains used in the invention, the average value (average aspect ratio) of their grain diameter/thickness ratios (aspect ratios) is not less than 2, more preferably not less than 2 and not more than 12, and most preferably 3 to 8.

In the invention, the grain diameter is the diameter of a circular image equivalent in the area to the projection image of the grain, and the grain's projection image area can be found from the sum of the areas of the grains; i.e., can be obtained by observing through an electron microscope a sample of silver halide crystal grains distributed so as not to overlap one another on a sample stand; and the thus obtained grain diameter of each crystal grain is preferably not less than 0.30 μm, more preferably 0.30 μm to 5 μm, and most preferably 0.40 μm to 2 μm.

An average grain diameter ($\phi i$), when the number of measured grain diameters is designated as n and the frequency of the grain having a diameter di is designated as ni, can be found from the following equation:

Average grain diameter ($\phi i$)=$\Sigma nidi/n$ (The number of measured grains shall be not less than 1000 at random.)

The thickness of the grain is the distance between the two parallel major faces that form a tabular grain, and can be obtained by observing aslant the grain through an electron microscope. The thickness of the tabular silver halide grain of the invention is preferably 0.03 to 1.0 μm, and more preferably 0.05 to 0.5 μm.

The external faces of the above tabular silver halide grain of the invention may be comprised substantially of either {111} face or {100} face, and may also be of both {111} and {100} faces in combination. In this instance, {111} face covers preferably 50% or more, more preferably 60% to 90% and most preferably 70% to 95% of the grain surface. The remaining area other than the {111} face is preferably {100} face. The {111}face/{100}face area proportion can be found by a method which utilizes the difference in the adsorption dependence property between sensitizers as described in T. Tani, J. Imaging Sci. 29, 165 (1985).

The tabular silver halide grains according to the invention may be either polydisperse or monodisperse, and is preferably monodisperse; to be concrete, the grain diameter distribution broadness expressed with the relative standard deviation (variation coefficient) derived from $$\frac{\text{Standard deviation of grain diameters}}{\text{Average grain diameter}} \times 100 = \text{grain diameter distribution broadness (\%)},$$

is preferably not more than 25%, more preferably not more than 20%, and most preferably not more than 15%.

The distribution of the thicknesses of the the tabular silver halide grains according to the invention is preferable to be small to be concrete, the grain thicknesses distribution broadness defined by $$\frac{\text{Standard deviation of thicknesses}}{\text{Average thickness}} \times 100 = \text{thickness distribution broadness (\%)}$$

is preferably not more than 25%, more preferably not more than 20%, and most preferably not more than 15%.

The ratio (b/a) of the grain thickness(b) to the longest distance(a) between 2 or more parallel twin planes which the silver halide grain of the invention has is preferably not less than 5 and not more than 30, and the number of grains having the ratio accounts for preferably not less than 50% of the whole grains of the emulsion.

The distance(a) between twin planes is the distance between two twin planes for a grain having two twin planes, or the largest value among the distances between twin planes for a grain having three or more twin planes.

The twin plane distance(a) can be determined as follows: A transmission-type-electron-microscopic observation of sample pieces is made to select arbitrary 100 or more tabular silver halide grains each showing its cross section cut perpendicularly to its principal plane, and individual grain's twin plance distances(a) are measured, totalled and then averaged to thereby obtain the distance (a).

In the invention, the average value (a) is preferably not less than 0.008 μm, and more preferably not less than 0.010 μm and not more than 0.05 μm.

In the invention, the distance (a) needs to be in the above value range, and at the same time its relative standard deviation needs to be not more than 35%, preferably not more than 30%.

Further in the invention, the flatness represented with factors including the aspect ratio and grain thickness by the equation: $A=ECD/b^2$ is preferably not less than 20, wherein ECD is the average grain diameter (μm) of tabular grains, and b represents the grain thickness.

The distribution of the silver halide content of each individual grain of the tabular silver halide grain emulsion of the invention is preferable to be small as well; to be concrete, the silver halide content distribution broadness defined by $$\frac{\text{Silver halide content stadard deviation}}{\text{Average silver halide content}} \times 100 = \text{silver halide contend distribution broadness (\%)}$$

is preferably not more than 25%, more preferably not more than 20% and most preferably not more than 15%.

In the invention, the tabular silver halide grain is preferably hexagonal. The hexagonal tabular grain implies that its major face ({111} face) is in the form of hexagon, and the maximum adjacent side ratio thereof is 1.0 to 2.0, wherein the maximum adjacent side ratio means the side length ratio of the longest one to the shortest one of the sides forming a hexagon. In the invention, the hexagonal tabular grain, if the maximum adjacent side ratio of it is 1.0 to 2.0, may be allowed to have round corners. Each side length in the case of round corners is expressed with the distance between the points at which lines formed by extending adjacent sides intersect. Almost circular tabular grains formed with their corners rounded are acceptable for the invention.

In the invention, ½ of the number of the sides forming the hexagonal tabular grain are preferably substantially in the form of straight lines. In the invention, the adjacent side ratio is preferably 1.0 to 1.5.

The silver halide grain of the invention may have a dislocation, which can be directly observed at a low temperature by using a transmission-type electron microscope as described in J. F. Hamilton, Phot. Sci. Eng., 57 (1967) and T. Shiozawa, J. Soc. Phot. Sci. Japan, 35, 213 (1972); that is, the silver halide grains sample from an emulsion is taken out with care not to apply as much pressure from the emulsion to the grains as to cause dislocation and is put on a mesh for electronmicroscopic observation, and the sample, in the state of being so cooled as to be prevented from being damaged (printout, etc.) by electron beams, is observed with a transmission light. In this instance, the larger the thickness of the grain, the less the electron beams transmit, so that it is better to use a high-voltage-type (more than 200 KV to the grain thickness of 0.25 μm) electron microscope to make a clearer observation.

From the photos of the grains recorded through an electron-microscope in the above manner there can be found the position of the dislocation of each grain. The dislocation position in the silver halide grain of the invention is preferable to be present in the region of up to 0.58 L–1.0 L, more preferably 0.80 L–0.98 L from the center of the silver halide grain toward the external surface. The dislocation line is almost in the direction from the center toward the external surface, but is often meandering.

In the invention, the center of the silver halide grain is the center of a circle formed as a circumcircle drawn so as to be the smallest to the silver halide grain's cross-section area, in which silver halide grain crystals are dispersed in a methacryl resin to be solidified, which is microtomed to prepare ultrathin slices, out of which the largest cross-section area-having slice and a slice having a cross-section area not less than 90% thereof are picked. In the invention, the distance L from the center up to the external surface is defined as the distance between the center and the point at which the line drawn outward from the above circle's center intersects the circum circle.

Regarding the number of dislocations in the silver halide grain of the invention, the number of grains having one or more dislocations preferably accounts for 50% by number of the whole grains of the emulsion; the larger (higher) the number (percentage) of tabular grains having dislocations, the better.

In the silver halide emulsion used in the light-sensitive material of the invention, the average overall iodide content of the grains in the emulsion comprising tabular silver halide grains having an average aspect ratio of not less than 2.0 is preferably not more than 2 mol %, more preferably 1.0 mol % and most preferably 0.5 mol %.

The average iodide content of the outermost surface of the tabular silver halide grains having an average aspect ratio of not less than 2.0 in the emulsion is preferably 3 mol % to 20 mol %, and more preferably 4 mol % to 15 mol %. The iodide content of the outermost surface is preferably higher than that of the inner side of the grain. Further, the distribution of the outermost-surface iodide contents of individual grains is preferred to be as much narrow as possible, and its variation coefficient is preferably not more than 25%, more preferably not more than 20%.

To the adjustment of the outermost-surface iodide content of the above tabular silver halide grain there can apply a method for adding simultaneously both a silver nitrate solution and an iodide ion-containing solution to the emulsion containing tabular grains as parent grains; a method of adding fine grains of silver halide such as silver iodide, silver iodobromide or silver chloroiodobromide; or a method of adding potassium iodide or a mixture of potassium iodide and potassium bromide. The most preferred among these methods is the addition of silver halide fine grains.

The above outermost-surface iodide content adjustment can be made at any point of time in the course from the final stage of the silver halide crystals growing process through the chemical ripening process up to the coating solution preparation process just before coating the silver halide emulsion, but is preferably made by the time of completion of the chemical ripening process. The chemical ripening process herein means the duration from the completion point of time of the physical ripening and desalting of the silver halide emulsion of the invention through the addition of chemical sensitizers up to the moment of stopping the chemical ripening process. The addition of the fine-grained silver iodide may be conducted intermittently at time intervals, and after the addition of the fine-grained silver iodide there may be further added other chemically-ripened emulsion. The temperature of the emulsion of the invention at the time of adding the fine-grained silver iodide thereto is preferably 30° to 80° C., more preferably 40° to 65° C. The invention is preferably practiced under conditions where the fine-grained silver iodide to be added, after its addition, vanishes partially or wholly during the period of time up to just before the emulsion coating. More preferably, 20% of more of the added fine-grained silver iodide should vanish by the time immediately before the coating. The determination of the vanished amount can be carried out in the following manner: The emulsion or coating liquor after the fine-grained silver iodide is added thereto is taken to be subjected to centrifugation under an appropriate condition then the supernatant is taken to have its absorption spectrum measured; and the measured absorption spectrum is compared with a reference absorption spectrum prepared with a known-concentration fine-grained silver iodide solution.

The outermost-surface in the invention is a silver halide phase in the surface region having a thickness of 50 A from the surface. Thus, the outmost-surface iodide content of the tabular silver halide grain according to the invention is an iodide content of the portion as deep as 50 A which has been determined by subjecting a sample of silver halide grains cooled down to −110° C. to the XPS (X-ray Photoelectron Spectroscopy) surface analysis method.

The iodide content of each individual grain can be measured by using the EPMA (Electron-Probe Micro Analyzer) method. The variation coefficient of the iodide content rates of individual grains can be determined in the same manner as in the variation coefficient of the foregoing various characteristics values; i.e., the iodide contents of at least 100 grains are measured according to the EPMA method, and the standard deviation of the iodide contents is divided by the average iodide content to give a value, which is multiplied by 100, whereby the variation coefficient is obtained.

In the tabular silver halide gain used in the invention, the portion of the grain except the outermost surface thereof may be of a uniform composition, but the light-sensitive silver halide emulsion layer of the invention preferably contains silver halide grains 50% by number or more of which are core/shell-type grains having thereinside a structure composed of at least two phases substantially different in the halide composition.

The core/shell-type grain can have in its central portion a region different in the halide composition from the core. The halide composition of seed grains in such a case as the above may be an arbitrarily combination of silver halides such as silver bromide, silver iodobromide, silver chloroiodobromide, silver chlorobromide, silver chloride, and the like.

The average silver iodide content of the silver halide emulsion of the invention is preferably not more than 2 mol %. In the grain having a structure of phases different in the halide composition, it preferably has thereinside a high-silver-iodide-content phase and has on the outmost shell thereof a low-silver-iodide-content phase or silver bromide phase. In this instance, the silver iodide content of the inside phase (core) having the highest silver halide content is preferably not less than 2.5 mol %, more preferably not less than 5 mol %, while the silver iodide content of the outmost shell is preferably 0 to 5 mol %, and more preferably 0 to 3 mol %. The silver iodide content of the core is preferably at least 3 mol % higher than that of the shell.

The silver iodide content of the core is normally uniform, but may vary to have a distribution thereof; for example, the concentration of silver iodide may get increased outwardly from the central part of the core or may have the maximum or minimum concentration in the middle region of the core.

The silver halide grain used in the invention may be the so called halogen conversion-type grain. The halogen conversion amount is preferably 0.2 to 2.0 mol % per mol of silver. The conversion may be carried out either during the physical ripening or after completion of the physical ripening process. The halogen conversion is normally carried out by adding to the silver halide grain an aqueous halogen solution whose solubility product with silver is smaller than the silver halide composition on the surface of the grain prior to undergoing halogen conversion treatment or fine-grained silver halide to the silver halide grain, wherein the grain diameter of the fine-grained silver halide is preferably not more than 0.2 μm, and more preferably 0.02 to 0.1 μm.

In the method for preparing a silver halide photographic emulsion of the tabular silver halide grain of the invention by providing an aqueous silver salt solution and an aqueous halide solution in the presence of a protective colloid, there is preferably used a grain-growing process comprising:

(a) a nucleus grain producing process to keep the pBr of mother liquor at 2.5 to −0.7 is provided over a period of not less than ½ of the duration from the initial stage of the formation of the silver halide precipitation having a silver iodide content of 0 to 5 mol %;

(b) the nucleus grain producing process is followed by either a seed grain forming process with the mother liquor containing a silver halide solvent in an amount $10^{-5}$ mol to 2.0 mol per mol of silver halide to form silver halide seed grains being substantially monodisperse spherical twin crystals or a seed grain forming process with the mother liquor at a temperature raised to 40°–80° C. to form silver halide twin crystal grains; and then (c) followed by a grain-growing process to grow the seed grain by adding thereto the aqueous silver salt solution, the aqueous halide solution and/or silver halide fine grains.

The mother liquor mentioned above means a solution (including silver halide emulsions) applied to the preparation of an emulsion up to the time of making it into the form of a complete photographic emulsion.

The silver halide grain formed in the above grain producing process is a twin crystal grain comprised of 0 to 5 mol % silver iodide.

An aqueous silver salt solution may be added for the purpose of ripening adjustment during the seed grain forming process of the invention.

The seed grain growing process can be accomplished by controlling pAg, pH, temperature, the concentration of the silver halide solvent, silver halide composition, the adding speed of silver salt and halide solutions during the silver halide precipitation and during the Ostwald ripening.

In the preparation of the emulsion of the invention, known silver halide solvents such as ammonia, thioether, thiourea, etc., may be present at the time of forming and growing the seed grain.

As the growing condition for the seed grain prepared for obtaining the tabular silver halide grain of the invention there may be used a method in which an aqueous silver salt solution and an aqueous halide solution are added according to a double-jet precipitation process at an adding speed being gradually changed within limits not allowing any new nucleus formation and Ostwald ripening to occur as the grain grows as described in JP O.P.I. Nos. 39027/1976, 142329/1980, 113928/1983, 48521/1979 and 49938/1983. As another growing condition of the seed grain there may also be used a method in which silver halide fine grains are added, dissolved and recrystalized as seen in Item 88 of the book of the gist of papers presented to the anual convention '83 of the Society of Photographic Science and Technology of Japan.

In the growth of grains both aqueous silver nitrate and halide solutions can be added according to a double-jet precipitation process, but the iodide can be supplied in the form of silver iodide into the reaction system, wherein the addition of both solutions is preferably made at a speed not allowing any new nucleus formation and any grain size distribution broadness increase due to Ostwald ripening to occur; i.e., at a speed in the range of 30 to 100% of the new nucleus forming speed.

In the preparation of the silver halide emulsion of the invention, the stirring condition in its manufacturing process is very important. The most preferred stirring device is one having therein a solution-adding nozzle as shown in JP O.P.I. No. 160128/1987 provided immersedly in liquid in the proximity to the mother liquor inlet hole, in which the number of revolutions of the stirrer is preferably 400 to 1200 rpm.

The iodide contents of the silver halide grains of the invention can be found according to EPMA (Electron Probe Micro Analizer) method. In this method, a sample of emulsion grains well dispersed so as to have the grains not to come in contact with one another is prepared, and therefore the method makes it possible to carry out an elementary analysis of much more minute details than the X-ray analysis using the electron beam excitation by the emission of electron beams. By finding the characteristic X-ray intensities of the silver and the iodide emitted from each grain according to this method, the silver halide composition of each individual grain can be determined. When the silver iodide contents of at least 100 grains are determined according to the EPMA method, an average silver iodide content can be obtained from the average thereof.

In the manufacture of the light-sensitive silver halide grain of the invention, it is preferred that in the seed emulsion 50% or more of the grains in the overall projection area of the seed grains have each parallel two or more twin planes, and the variation coefficient of the thicknesses of the seed grains and that of the longest distances ($a_t$) between the twin planes of the seed grains are both preferably not more than 35%.

Even if the variation coefficient of either one alone of the thicknesses or the longest distances($a_t$) between twin planes of the seed grains were held down to not more than 35%, the variation coefficient of the distances(a) between twin planes of the grown grains can not be held down to less than 35%; it is necessary for both to accomplish the same simultaneously.

Further, the silver halide grain according to the invention may have metallic ions of at least one of salts selected from among cadmium salts, zinc salts, lead salts, thalium salts, iridium salts (including complex salts thereof), rhodium salts (including complex salts thereof) and iron salts (including complex salts thereof) added thereto to have these metal elements incorporated into the inside and/or surface phase of the grain; or the grain, by being placed in an appropriate reductive atmosphere, can have a reduction sensitization nucleus provided to the inside and/or surface phase thereof.

The action of a reducing agent that was added at a discretionary point of time during the grain formation is preferably restrained or stopped through being inactivated by adding hydrogen peroxide (water) and an adduct thereof, a peroxoacid salt, ozone, $I_2$, and the like at an arbitrary point of time.

The time when an oxidizing agent should be added can be discretionarily selected during the period from the silver halide formation up to the chemical sensitization process.

The silver halide emulsion of the silver halide photographic light-sensitive material of the invention may have its useless water-soluble salts either removed therefrom after completion of growing its silver halide grains or remain unremoved. Where the salts should be removed, the removal can be conducted according to the method described in Research Disclosure No. 17649, Item II.

The silver halide emulsion layer containing a group of grains within the scope of the invention may also contain silver halide grains other than the tabular grains of the invention within limits not to impair the effect of the invention.

In the invention, it is also preferable to add a silver halide solvent prior to the desalting process in order to accelerate the developing speed. For example, it is preferred to add a thiocyanic acid compound, such as potassium thiocyanate, sodium thiocyanate or ammonium thiocyanate, in an amount of $1\times10^{-3}$ to $3\times10^{-2}$ mol per mol of silver.

The latex for use in the invention is preferably one having little or no bad influence at all in the following points. Namely, the above implies that the surface of the latex used shall be as photographically inactive as to have very little interactions with various photographic additives, for example, as in the cases where the latex adsorbs dyes or coloring agents to make a photographic element hard to get stained; where the latex hardly adsorbs a development accelerator or a development inhibitor, influencing the developing speed, and therefore little affects the sensitivity or fogging where when manufacturing a photographic element, there is little dependence of it upon pH in a photographic solution having the latext of the invention dispersed therein; and where the latex is little affected by ion intensities, so that it little aggregates.

The fact that the latex usable in the invention has the above characteristics is considered largely attributable to the monomer composition and the nature of this latex.

To the latex there is often applied an indication called glass transition point. The higher the glass transition point is, the harder the latex become to be unable to play its role as a buffer, but on the contrary, when the transition point is low, generally the latex is liable to interact with photographic characteristics, resulting in bad consequences. For this reason, the selection of the latex composition and the using amount of the latex are not simple when taking account of the photographic characteristics. There are well-known latexes comprised of monomers such as styrene, butadiene, vinylidene and the like. The introduction of a monomer having a carboxylic acid group, such as acrylic acid, itaconic acid, maleic acid, or the like, into a latex at the time of its synthesis is said to reduce its influence upon photographic characteristics, and attempts have often been made to do such synthesis methods. It is also preferred that the glass transition point be appropriately set up according to the type of the light-sensitive material by the incorporation of a methacrylate unit into the latex that has been obtained in the above-mentioned combination. For particular examples of the latex in connection with the glass transition point reference can be made to JP O.P.I. No. 135335/1992 and Japanese Patent Application Nos. 119113/1993 and 119114/1993.

The incorporation of a dye that can be decolored and/or eluted during development into at least any one of the layer containing the light-sensitive silver halide emulsion of the invention and other non-emulsion component layers enables to obtain a light-sensitive material having a high sensitivity and capable of forming a high-sharpness image with little dye stain. The dye applicable to the light-sensitive material may be arbitrarily selected from among those dyes capable of absorbing desired wavelength band according to the light-sensitive material to remove the influence by the wavelength to thereby improve the image sharpness. The dye should be decolored or eluted off in the developing process of the light-sensitive material, and the dye, at the time of completion of developing an image, is preferably almost invisible.

The dye according to the invention is substantally insoluble in water at pH of 7 or lower, but is substantially soluble in water at pH of 8 or above; to be concrete, it is selected from the group consisting of the compounds represented by the following Formulas [1] to [6]:

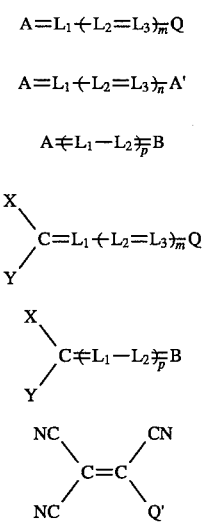

Formula [1]

Formula [2]

Formula [3]

Formula [4]

Formula [5]

Formula [6]

In the above formulas, A and A' may be either the same as or different from each other and each represent an acidic nucleus; B represents a basic nucleus; Q represents an aryl group or a heterocyclic group; Q' is a heterocyclic group; X and Y may be either the same as or different from each other and each represent an electron attractive group; $L_1$, $L_2$ and $L_3$ each represent a methine group; m is an integer of 0 or 1; n is an integer of 0 or 1; and p represents an integer of 0 or 1. Provided that each of the dyes of Formulas [1] to [6] has in its molecule at least one group selected from among carboxy, sulfonamido and sulfamoyl groups.

Preferred examples of the acid nucleus represented by the A or A' of Formulas [1], [2] and [3] include 5-pyrazolone, barbituric acid, thiobarbituric acid, rhodanine, hydantoin, thiohydantoin, oxazolone, isooxazolone, indandione, pyrazolidindione, oxazolinedione, hydroxypyridone and pyrazolopyridone.

Preferred examples of the basic nucleus represented by the B of Formulas [3] and [5] include pyridine, quinoline, oxazole, benzoxazole, naphthooxazole, thiazole, benzothiazole, naphthothiazole, indolenine, pyrrole and indole.

Examples of the aryl group represented by the Q of Formulas [1] and [4] include a phenyl group and a naphthyl group. Examples of the heterocyclic group represented by the Q and Q' of Formulas [1], [4] and [6] include a pyridyl group, a quinolyl group, an isoquinolyl group, a pyrrolyl group, a pyrazolyl group, an imidazolyl group, an indolyl group, a furyl group and a thienyl group. The above aryl and heterocyclic groups include those having a substituent, and examples of the substituent include an alkyl group, a cycloalkyl group, an alkenyl group, an aryl group, a halogen atom, an alkoxycarbonyl group, an aryloxycarbonyl group, a carboxy group, a cyano group, a hydroxy group, a mercapto group, an amino group, an alkoxy group, an aryloxy group, an acyl group, a carbamoyl group, an acylamino group, a ureido group and a sulfonamido group, a sulfamoyl group; two or more of these groups may be used in combination. The preferred among these substituents are alkyl groups having 1 to 8 carbon atoms, such as methyl, ethyl, t-butyl, n-octyl, 2-hydroxyethyl, 2-methoxyethyl hydroxy group, cyano group; halogen atoms such as fluorine and chlorine atoms; alkoxy groups having 1 to 6 carbon atoms, such as methoxy, ethoxy, 2-hydroxyethoxy, methylenedioxy, n-butoxy; substituted amino groups such as dimethylamino, diethylamino, di-(n-butyl)amino, N-ethyl-N-hydroxyethylamino, N-ethyl-N-methanesulfonamidoethylamino, morpholino, piperidino, pyrolidino; carboxy group, sulfonamido groups such as methanesulfonamido, benzenesulfonamido; and sulfamoyl groups such as sulfamoyl, methylsulfamoyl, phenylsulfamoyl. These groups may be used in combination.

The electron attractive groups represented by the X and Y of Formulas [4] and [5] may be either the same or different, whose substituent constant Hammett's σp value (described in 'Yakubutsu No Kozo-Kassei Sokan (Structure-Activity Correlations of Chemicals)' edited by Fujita, carried in 'Kagaku No Ryoiko' special ed. No. 122, pp. 96–103 (1979), Nankodo) is preferably not less than 0.3, examples of which include cyano group; alkoxycarbonyl groups such as methoxycarbonyl, ethoxycarbonyl, butoxycarbonyl, octyloxycarbonyl; aryloxycarbonyl groups such as phenoxycarbonyl, 4-hydroxyphenoxycarbonyl; carbamoyl groups such as carbamoyl, methylcarbamoyl, ethylcarbamoyl, butylcarbamoyl, dimethylcarbamoyl, phenylcarbamoyl, 4-carboxyphenylcarbamoyl; acyl groups such as methylcarbonyl, ethylcarbonyl, butylcarbonyl, phenylcarbonyl, 4-ethylsulfonamidophenylcarbonyl; alkylsulfonyl groups such as methylsulfonyl, ethylsulfonyl, butylsulfonyl, octylsulfonyl; and arylsulfonyl groups such as phenylsulfonyl, 4-chlorosulfonyl.

The methine group represented by the $L_1$, $L_2$ and $L_3$ of Formulas [1] to [5] include those having a substituent, and examples of the substituent include alkyl groups having 1 to 7 carbon atoms, such as methyl, ethyl, hexyl; aryl groups such as phenyl, tolyl, 4-hydroxyphenyl; aralkyl groups such as benzyl, phenethyl; heterocyclic groups such as pyridyl, furyl, thienyl; substituted amino groups such as dimethylamino, diethylamino, anilino; and alkylthio groups such as methylthio.

In the invention, the useful among the dyes represented by Formulas [1] to [6] is preferably a dye having at least one carboxy group in its molecular, more preferably a dye represented by Formula [1], and most preferably a dye represented by Formula [1] of which the Q is a furyl group.

The following are examples of the dye used in the invention.

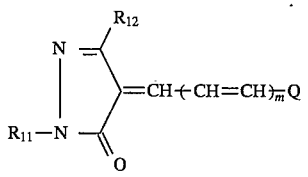
| No. | $R_{11}$ | $R_{12}$ | Q | m |
|---|---|---|---|---|
| 1-1 | 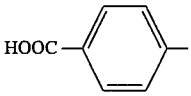 | $CH_3$ | 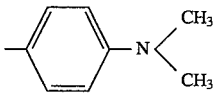 | 0 |
| 1-2 | 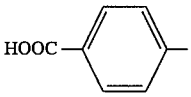 | $COOC_2H_5$ | 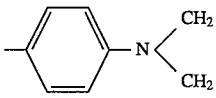 | 0 |
| 1-3 | 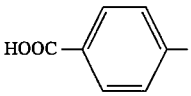 | $COCH_3$ | 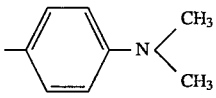 | 0 |
| 1-4 | 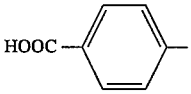 | CN | 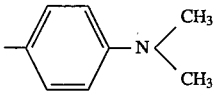 | 0 |
| 1-5 | 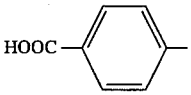 | $CONH_2$ | 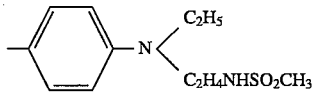 | 0 |
| 1-6 | 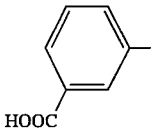 | $CH_3$ | 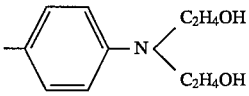 | 1 |
| 1-7 | 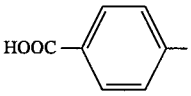 | $CONH_2$ | 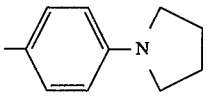 | 0 |
| 1-8 | 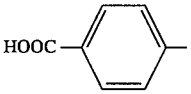 | $CH_3$ | 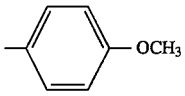 | 0 |
| 1-9 | 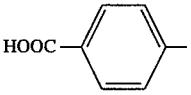 | CN | 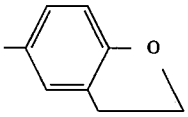 | 0 |
| 1-10 | 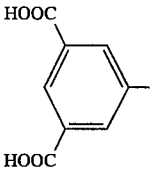 | $COOC_2H_5$ | 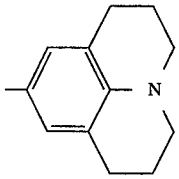 | 0 |
| 1-11 | 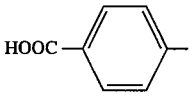 | $CH_3$ | 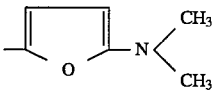 | 0 |
| 1-12 | 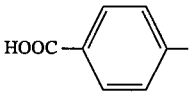 | $COOC_2H_5$ | 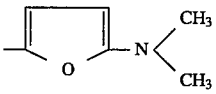 | 0 |

-continued
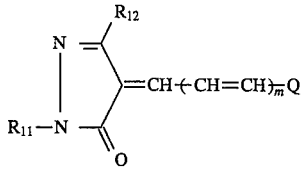
| No. | $R_{11}$ | $R_{12}$ | Q | m |
|---|---|---|---|---|
| 1-13 | 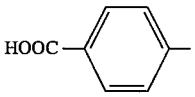 | $CONH_2$ | 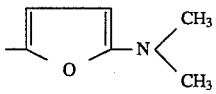 | 0 |
| 1-14 | 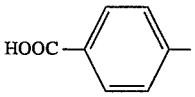 | $COCH_3$ | 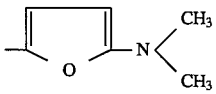 | 0 |
| 1-15 | 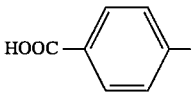 | CN | 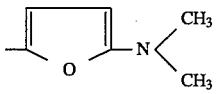 | 0 |
| 1-16 | 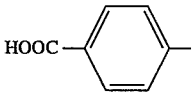 | CN | 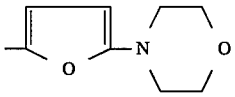 | 0 |
| 1-17 | 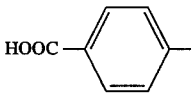 | CN | 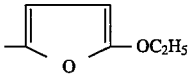 | 0 |
| 1-18 | 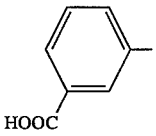 | CN | 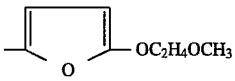 | 1 |
| 1-19 | 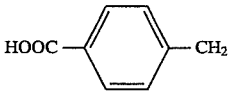 | $CONH_2$ | 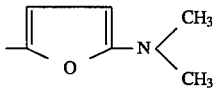 | 0 |
| 1-20 | 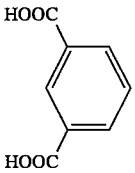 | CN | 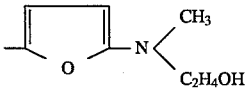 | 1 |
| 1-21 | 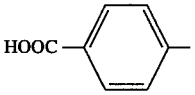 | $CH_3$ | 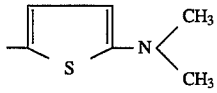 | 0 |
| 1-22 | 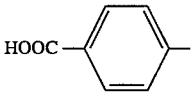 | CN | 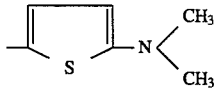 | 0 |
| 1-23 | 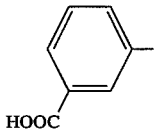 | $COOC_2H_5$ | 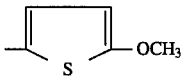 | 0 |

-continued
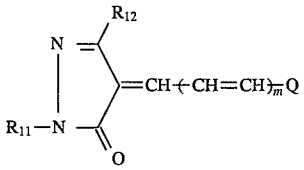
| No. | $R_{11}$ | $R_{12}$ | Q | m |
|---|---|---|---|---|
| 1-24 | 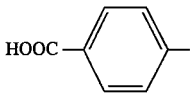 | $CH_3$ | 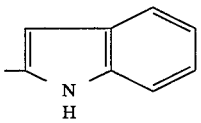 | 0 |
| 1-25 | 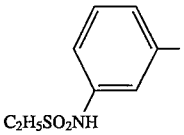 | $CONHCH_3$ | 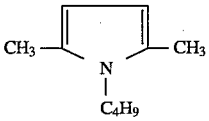 | |
| 1-26 | 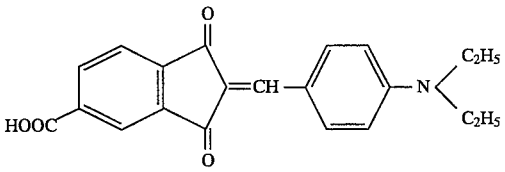 | | | |
| 1-27 | 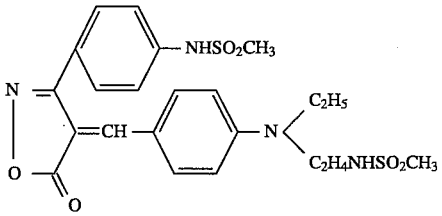 | | | |
| 1-28 | 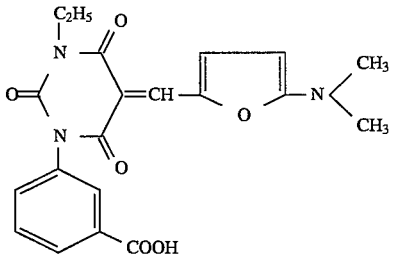 | | | |
| 1-29 | 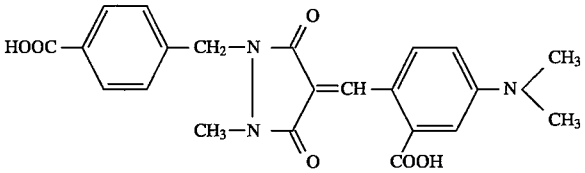 | | | |

-continued
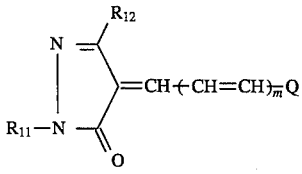
| No. | $R_{11}$ | $R_{12}$ | Q | m |
|---|---|---|---|---|
| 1-30 | 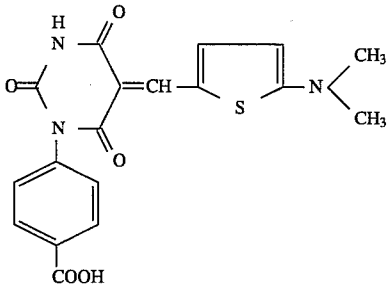 | | | |
-continued
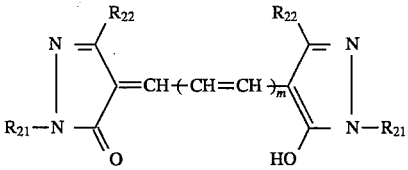
| No. | $R_{21}$ | $R_{22}$ | m |
|---|---|---|---|
| 2-1 | 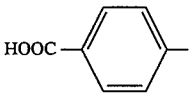 | $CH_3$ | 0 |
| 2-2 | 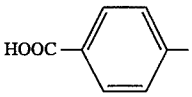 | $CH_3$ | 1 |
| 2-3 | 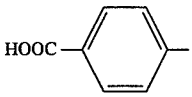 | $CH_3$ | 2 |
| 2-4 | 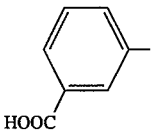 | $COOC_2H_5$ | 0 |
| 2-5 | 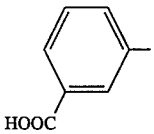 | $COOC_2H_5$ | 1 |
| 2-6 | 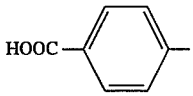 | $CONH_2$ | 1 |
| 2-7 | 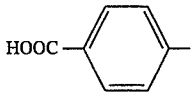 | CN | 1 |
-continued
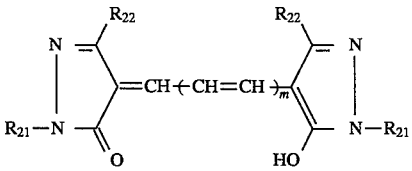
| No. | $R_{21}$ | $R_{22}$ | m |
|---|---|---|---|
| 2-8 | 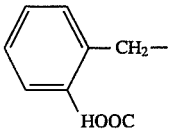 | $NHCONHCH_3$ | 1 |
| 2-9 | 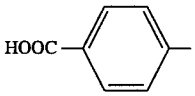 | $OC_2H_5$ | 1 |
| 2-10 | 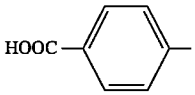 | $COCH_3$ | 1 |
| 2-11 | 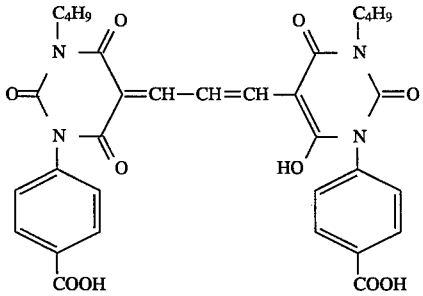 | | |

-continued
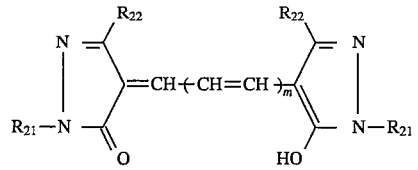
| No. | $R_{21}$ | $R_{22}$ | m |
|---|---|---|---|
| | 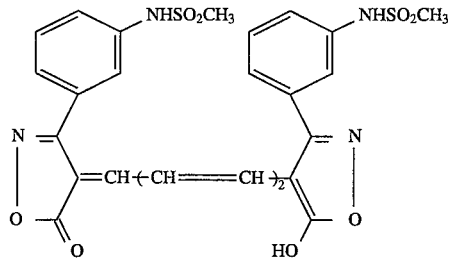 | | |
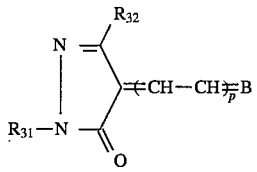
| No. | $R_{31}$ | $R_{32}$ | B | p |
|---|---|---|---|---|
| 3-1 | 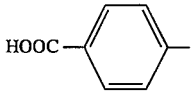 | $CH_3$ | 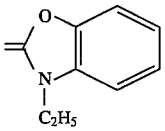 | 1 |
| 3-2 | 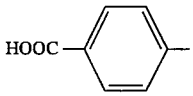 | $CF_3$ | 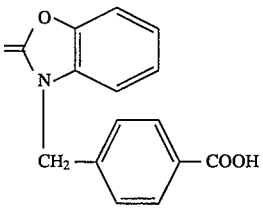 | 2 |
| 3-3 | 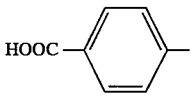 | $COOC_2H_5$ | 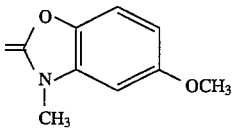 | 1 |
| 3-4 | 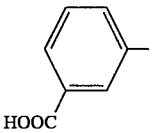 | CN | 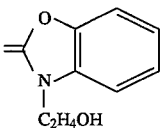 | 1 |
| 3-5 | 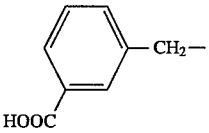 | $CONH_2CH_3$ | 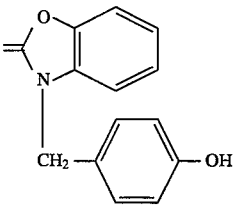 | 1 |

-continued
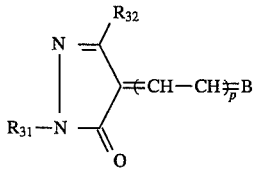
| No. | $R_{31}$ | $R_{32}$ | B | p |
|---|---|---|---|---|
| 3-6 | 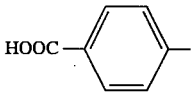 | CN | 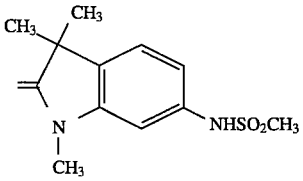 | 1 |
| 3-7 | 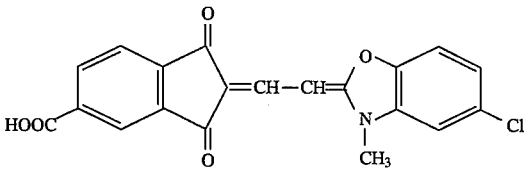 | | | |
| 3-8 | 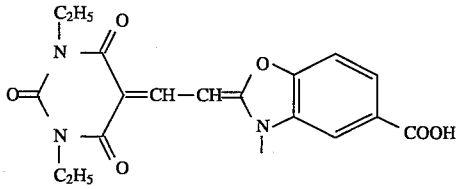 | | | |
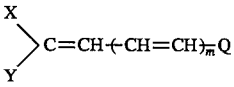
| No. | X | Y | Q | m |
|---|---|---|---|---|
| 4-1 | $COOC_2H_5$ | 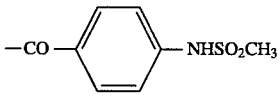 | 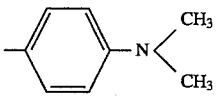 | 0 |
| 4-2 | $COCH_3$ | 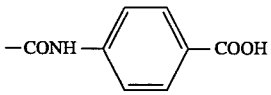 | 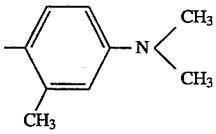 | 0 |
| 4-3 | CN | 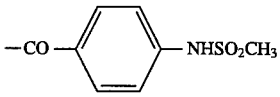 | 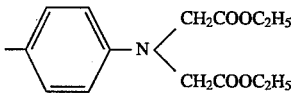 | 0 |
| 4-4 | CN | 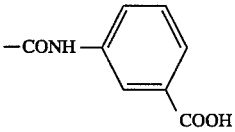 | 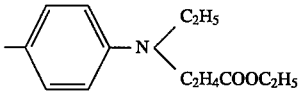 | 0 |
| 4-5 | CN | 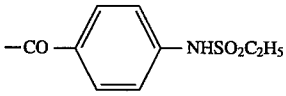 | 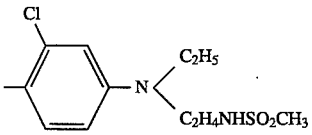 | 0 |

-continued
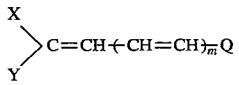
| No. | X | Y | Q | m |
|---|---|---|---|---|
| 4-6 | CN | 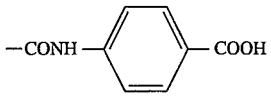 | 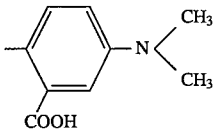 | 1 |
| 4-7 | $SO_3CH_3$ | 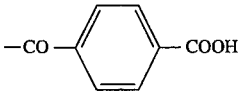 | 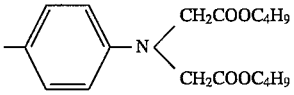 | 0 |
| 4-8 | | 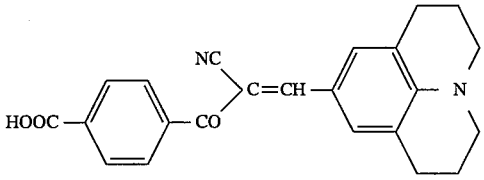 | | |
| 4-9 | | 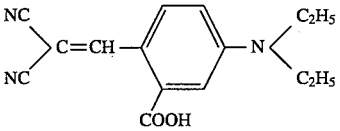 | | |
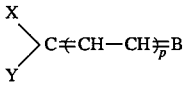
| No. | X | Y | B | p |
|---|---|---|---|---|
| 5-1 | CN | 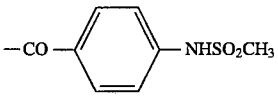 | 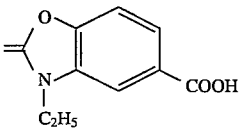 | 1 |
| 5-2 | CN | 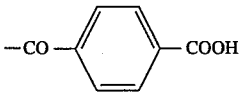 | 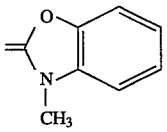 | 1 |
| 5-3 | CN | 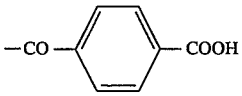 | 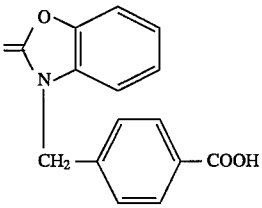 | 1 |
| 5-4 | CN | 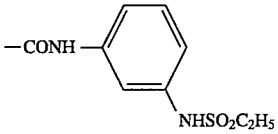 | 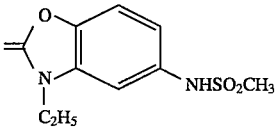 | 1 |

-continued

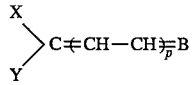

| No. | X | Y | B | p |
|---|---|---|---|---|
| 5-5 | $SO_2C_4H_9$ | $SO_2C_4H_9$ | 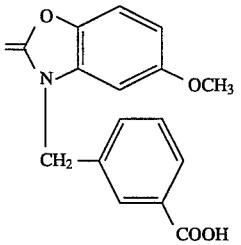 | 1 |
| 5-6 | CN | 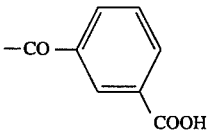 | 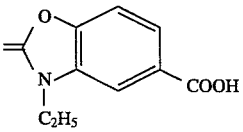 | 2 |
| 5-7 | 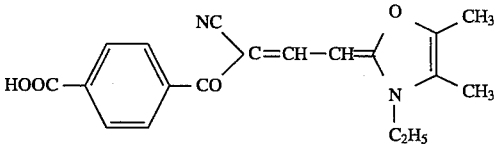 | | | |
| 5-8 | 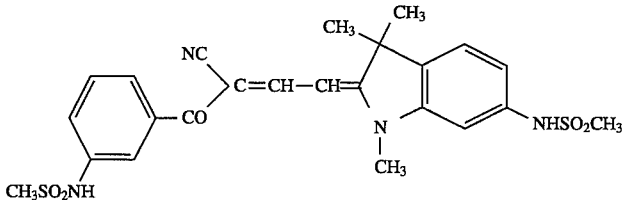 | | | |

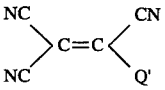

| No. | Q' |
|---|---|
| 6-1 | 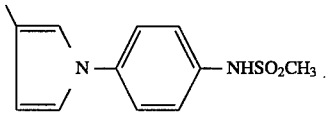 |
| 6-2 | 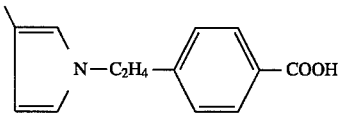 |
| 6-3 | 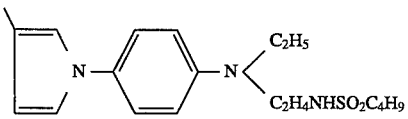 |
| 6-4 | 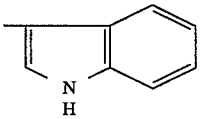 |

-continued

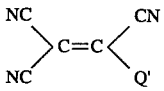

| No. | Q' |
|---|---|
| 6-5 | 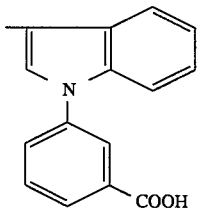 |

The above exemplified compounds, applicable to the invention, are described in JP O.P.I. Nos. 92716/1977, 120030/1980, 155350/1980, 155351/1980, 12639/1981, 197943/1988, 1838/1990 and 1839/1990; World Patent No. 88/04794; U.S. Pat. Nos. 4,861,700 and 4,950,586; and European Patent No. 489,973, and their syntheses may also be carried out in accordance with the methods described in the above publications.

For the preparation of the solid particle dispersion of the dye of the invention there may be used appropriate one of the methods described in JP O.P.I. Nos. 92716/1977, 155350/1980, 155351/1980, 197943/1988 and 182743/

1991; and World Patent WO88/04794. To be concrete, it can be prepared with a surfactant by using a finely dispersing machine such as a ball mill, oscillation mill, planetary mill, sand mill, roller mill, jet mill, disk impeller mill, or the like. Alternatively, the dispersion of the dye can be obtained by a method in which the dye is dissolved in a weak alkali aqueous solution, and then pH of the solution is lowered to thereby precipitate a fine-grained solid, or also by a method in which a weak alkali solution of the dye and an acid aqueous solution of the same dye are simultaneously mixed with pH being adjusted to thereby prepare a fine-grained solid. The dye may be used alone or in a mixture of two or more kinds thereof. In the case of using a mixture of two or more kinds, the mixing may be conducted either after separately dispersing the respective kinds or simultaneously with dispersing.

The dye dispersed in the form of a solid particle dispersion of the invention preferably has an average particle size of 0.01 μm to 5 μm, more preferably 0.01 μm to 1 μm, and most preferably 0.01 μm to 0.5 μm. The variation coefficient of the particle size distribution is preferably not more than 50%, more preferably not more than 40%, and most preferably not more than 30%, wherein the variation coefficient of the particle size distribution is a value calculated according to the following formula:

$$\frac{\text{Standard deviation of particle sizes}}{\text{Average particle size}} \times 100$$

Requirements as the antiseptic for the solid particle dispersion of the dye used in the photographic light-sensitive material are that it should have no interaction with photographic additives; should show even in a small amount a large antimold/fungicide effect upon microbes such as bacteria, yeast, mold, etc.; should have no influence upon photographic characteristics such as desensitization, fog, graininess and sharpness; and should have no influence upon photographic processing performance such as developability and fixability.

As the surfactant used in the invention there may be used any one of anionic, nonionic, cationic and amphoteric surfactants, but the preferred surfactant includes anionic surfactants such as alkylsulfonates, alkylbenzenesulfonates, alkylnaphthalenesulfonates, alkylsulfates, sulfosuccinates, sulfoalkylpoly-oxyethylenealkylphenylethers and N-acyl-N-alkyltaurines, and nonionic surfactants such as saponin, alkyleneoxide derivatives and alkylene esters of sugar.

The using amount of the anionic surfactant and/or nonionic surfactant differs according to the type of the surfactant used or the foregoing dye dispersion conditions, but is preferably 0.1 to 2000 mg, more preferably 0.5 to 1000 mg and most preferably 1 to 500 mg per gram of the dye. The dye concentration in its dispersion is preferably 0.01 to 10% by weight, more preferably 0.1 to 5% by weight. The surfactant is preferably added prior to the commencement of dispersing the dye or, if necessary, further added to the dye dispersion liquid after completion of its dispersion. The anionic surfactant or nonionic surfactant may be used alone or in combination of two or more kinds of each surfactant, and both may be used in combination.

To the dye dispersion of the invention may be added a hydrophilic colloid usable as the binder for photographic component layers before starting or after completion of its dispersing. As the hydrophilic colloid, the use of gelatin is advantageous, and other examples of it include gelatin derivatives such as phenylcarbamylated gelatin, acylated gelatin, phthalated gelatin graft polymers comprised of gelatin with polymerizable ethylene-having monomers; cellulose derivatives such as carboxymethyl cellulose, hydroxymethyl cellulose, cellulose sulfate; synthetic aqueous polymers such as polyvinyl alcohol, partially oxidized polyvinyl acetate, polyacrylamide, poly-N,N-dimethylacrylamide, poly-N-vinylpyrrolidone, polymethacrylic acid; agar-agar, gum arabic, alginic acid, albumine, casein, and the like. These may be used in combination. The adding amount of the hydrophilic colloid to the dye dispersion of the invention is preferably 0.1 to 12% by weight, and more preferably 0.5 to 8% by weight.

In the invention, the component layer to contain the dye is preferably a silver halide emulsion layer or a layer that is located closer than the emulsion layer to the support or can be both layers, and more preferably, it is effective to incorporate the dye into a layer provided adjacent to a transparent support. It is preferable for the dye to have a higher concentration when located on a closer side to the support than a far side.

In the invention, the adding amount of the above dye can be varied according to the intended image sharpness; preferably 0.2 to 20 mg/m$^2$, and more preferably 0.8 to 15 mg/m$^2$.

In the light-sensitive material of the invention, where the silver halide emulsion layer is to be colored, the dye is added either to the silver halide emulsion or to an aqueous hydrophilic colloid solution, and the dye-added solution is coated either directy or through other hydrophilic colloid layer on the support in accordance with an appropriate one of various methods.

As aforementioned, the dye preferably has a higher concentration on a side closer to the support, but in order to fix the dye in a closest possible position to the support, there may be used a mordant such as a nondiffusible mordant capable of combining with at least one type of the above-mentioned dye the preferably usable examples of such mordants are described in West German Patent No. 2,263,031; British Patent Nos. 1,221,131 and 1,221,195; JP O.P.I. Nos. 47624/1975 and 71332/1975; JP E.P. No. 1418/1976; U.S. Pat. Nos. 2,548,564, 2,675,316, 2,795,519, 2,839,401, 2,882,156, 3,048,487, 3,184,309, 3,444,138, 3,445,231, 3,706,563, 3,709,690 and 3,788,855.

For binding the nondiffusible mordant with the dye in practicing the invention there may be used various methods known to those skilled in the art particularly a method for making the binding in a gelatin binder is suitably used. And other method in which the binding is made in an appropriate binder, and then dispersed in an aqueous gelatin solution by an ultrasonic wave may also be used.

Although the binding ratio depends upon the type of compounds used, normally 0.1 part to 10 parts of the nondiffusible mordant are used to combine to 1 part of an aqueous dye solution. The amount of the dye added in the form of an aqueous solution of it, because of being bound with the nondiffusible mordant, may be larger than when used alone.

When the dye-nondiffusible mordant-combined material should be incorporated into the light-sensitive material, a component layer exclusive for the material may be established, and the position of it, although discretionarily selectable, is preferably adjacent to the transparent support.

For the silver halide light-sensitive material of the invention there may be used various photographic additives. Well-known photographic additives include the compounds described in Reseach Disclosure No. 17643 (December 1978), No. 18716 (November 1979) and No. 308119 (December 1989), wherein the relevant types of compounds and their sections are as follows:

| Additive | RD-17643 Page | RD-17643 Sec. | RD-18716 Page | RD-308119 Page | RD-308119 Sec. |
|---|---|---|---|---|---|
| Chemical sensitizers | 23 | III | 648 upper right | 996 | III |
| Spectral sensitizers | 23 | IV | 648–649 | 996–8 | III |
| Desensitizers | 23 | IV | | 998 | B |
| Dyes | 25–26 | VIII | 649–650 | 1003 | VIII |
| Development accelerators | 29 | XXI | 648 upper right | | |
| Antifoggants/stabilizers | 24 | IV | 649 upper right | 1006–7 | VI |
| Brightening agents | 24 | V | | 998 | V |
| Surfactants | 26–27 | XI | 650 right | 1005–6 | XI |
| Antistatic agents | 27 | XII | 650 right | 1006–7 | XIII |
| Plasticizers | 27 | XII | 650 right | 1006 | XII |
| Sliding agents | 27 | XII | | | |
| Matting agents | 28 | XVI | 650 right | 1008 | XVI |
| Binders | 26 | XXII | | 1009–4 | XXII |
| Support materials | 28 | XVII | | 1009 | XVII |

The silver halide light-sensitive material of the invention may contain in the emulsion layer or other component layer thereof a developing agent such as aminophenol, ascorbic acid, pyrocatechol, hydroquinone, phenylenediamine or 3-pyrazolidone.

The hydrophilic colloid of the silver halide emulsion layer and non-light-sensitive layer of the light-sensitive material of the invention preferably contains an inorganic or organic hardener. Examples of the hardener include chromates such as chrome alum, chrome acetate; aldehydes such as formaldehyde, glyoxal, glutaraldehyde; N-methylol compounds such as dimethylolurea, methylolhydantoin; dioxane derivatives such as 2,3-dihydroxydioxane; active vinyl compounds such as 1,3,5-triacryloyl-hexahydro-s-triazine, bis(vinylsulfonyl)-methyl ether, N,N'-methylene-bis(β-(vinylsulfonyl-)propionamide; active halogen compounds such as 2,4-dichloro-6-hydroxy-s-triazine; mucohalogenic acids such as mucochloric acid, mucophenoxychloric acid; and isooxazoles such as 2-chloro-6-hydroxytriazinylated gelatin. These compoundes may be used alone or in combination. The preferred among these compounds are the active halogen compounds described in JP O.P.I. Nos. 41221/1978, 57257/1978, 162456/1984 and 80846/1985.

As the hardener of the invention there may be effectively used polymer hardeners, preferable examples of which include dialdehyde starch, polyacrolein; aldehydo group-having polymers like the acrolein copolymer described in U.S. Pat. No. 3,396,029; the epoxy group-having polymers described in U.S. Pat. No. 3,623,878; the dichlorotriazine group-having polymers described in U.S. Pat. No. 3,362,827 and Reseach Disclosure 17333 (1978); the active ester group-having polymers described in JP O.P.I. No. 66841/1981; and the polymers having an active vinyl group or a precursor thereof described in JP O.P.I. Nos. 142524/1981 and 65033/1979, and RD-16725 (1978). Of the above compounds, the most preferred are polymers in which the active vinyl group or its precursor is linked through a long spacer to the polymer's principal chain as described in JP. O.P.I. No. 142524/1981.

In order to make the photographic light-sensitive material of the invention adaptable to rapid processing, it is preferable to reduce its moisture content prior to starting its drying step in the manner of adjusting its water-swelling degree in the developing-fixing-washing process by in advance adding an appropriate amount of a hardener thereto in the coating process thereof.

The swelling degree of the silver halide light-sensitive material of the invention in a developer solution is preferably 150% to 250%, and the layer thickness after the swelling is preferably not more than 70 μm. If the swelling degree exceeds 250%, drying trouble occurs, which, in an autoprocessor processing, particularly in rapid processing, also results in a transport failure, while if the swelling degree is less than 150%, it tends to cause the light-sensitive material to form an image lacking in uniformity when developed and also to be deteriorated with residual color. The swelling degree herein is a value obtained in the manner that the difference between the thickness of the light-sensitive material after being swelled in the respective processing solutions and the thickness of the material prior to the processing is divided by the thickness prior to the processing, and the divided value is then multiplied by 100.

Materials usable as the support for the light-sensitive material of the invention include those as described in the aforementioned publications: RD-17643 p. 28, and RD-308119 p. 1009.

Suitable as the support are plastic films. The support, in order to improve its adhesion to the coated layer, may be provided thereon with a subbing layer or subjected to surface treatment such as corona-discharge treatment or ultraviolet ray irradiation treatment.

The silver halide photographic light-sensitive material of the invention is one that comprises the above-mentioned silver halide emulsion of the invention, and is available as, e.g., black-and-white silver halide photographic light-sensitive materials such as medical light-sensitive material, graphic arts light-sensitive material, negative light-sensitive material for general photographing use; color photographic light-sensitive materials such as color negative light-sensitive material, color reversal light-sensitive material, color prints-making light-sensitive material; light-sensitive materials for diffusion transfer process, and light-sensitive materials for thermal development process. Especially, the light-sensitive material of the invention is used preferably as a black-and-white silver halide photographic light-sensitive material, and more preferably used as a light-sensitive material for medical use.

In the case of applying the invention to the medial X-ray radiography, for example, there is used an X-ray intensifying screen composed principally of phosphor that emits near ultraviolet light or visible light by being exposed to transmitting radiant rays. The light-sensitive material of the invention used for this purpose is a both-sided emulsion film which is preferably used with the intensifying screen closely applied to both sides thereof to be exposed to the radiant rays.

The transmitting radiant rays herein are high-energy electromagnetic waves, including X-rays and γ-rays.

The above X-ray intensifying screen or fluorescent screen includes a screen comprised principally of calcium tungstate, or a screen comprised principally of a rare earth compound activated with terbium. The intensifying screen applicable to the invention is one prepared by uniformly coating a phosphor component on a base in the sheet, sylindrical or conical form. Where a low-sensitivity light-sensitive material is used, it is preferable to use an X-ray intensifying screen of which the sensitivity is raised and at the same time the quantum mottle is reduced to improved the graininess by increasing the thickness of the phosphor component and coating the component in the conical form as in the microstructure intensifying screen described in the German Karman Nuclear Research presented to the '92 RSNA session 868C.

The preferred processing procedure for the light-sensitive material of the invention is described below:

Useful examples of the developing agent used in a developer solution for developing the light-sensitive material of the invention include the dihydroxybenzene described in JP O.P.I. Nos. 15641/1992 and 16841/1992, such as hydroquinone; p-aminophenols such as p-aminophenol, N-methyl-p-aminophenol, 2,4-diaminophenol; 3-pyrazolones such as 1-phenyl-3-pyrazolidone, 1-phenyl-3-pyrazolidone, 1-phenyl-4-methyl-4-hydroxymethyl-3-pyrazolidone, and 5,5-dimethyl-1-phenyl-3-pyrazolidone. These compounds are preferably used in combination.

The using amount of the above p-aminophenol or 3-aminopyrazolidone is preferably 0.004 mol/liter, and more preferably 0.04 to 0.12 mol/liter.

The total of the molar numbers of the dihydroxy benzene, p-aminophenol and 3-pyrazolone contained in the whole developer components is preferably not more than 0.1 mol/liter.

The developer solution may contain as the preservative thereof a sulfite such as potassium sulfite or sodium sulfite; and a reductone such as piperidinohexosereductone, which may be used preferably 0.2 to 1 mol/liter, more preferably 0.3 to 0.6 mol/liter. The addition of a large amount of an ascorbic acid leads to improving the processing stability.

Examples of the alkali agent for the developer solution include pH adjusting agents such as sodium hydroxide, potassium hydroxide, sodium carbonate, potassium carbonate, sodium triphosphate and potassium triphosphate. Besides, there may be used a buffer selected from among the borates described in JP O.P.I. No. 28708/1986, and the saccharose, acetoxime, 5-sulfosalicylic acid, phosphates, and carbonates described in JP O.P.I. No. 93439/1985. The amount of any of these chemicals to be contained in the developer solution is determined so as to make pH preferably 9.0 to 13, and more preferably 10 to 12.5.

The developer may also contain a dissolution assistant such as a polyethylene alcohol or an esters thereof; a sensitizer such as a quaternary ammonium salt; a development accelerator and a surfactant.

As the anti-silver-sludge agent for the developer solution there may be used preferably the sulfide and disulfide compounds described in JP O.P.I. No. 51844/1991; and the cysteine derivatives or triazine compounds described in Japanese Patent Application No. 92947/1992.

Usable as the organic restrainer for the developer solution are azole organic antifoggants including indazole compounds, imidazole compounds, benzimidazole compounds, triazole compounds, benzotriazole compounds, tetrazole compounds and thiadiazole compounds.

Examples of the inorganic restrainer include sodium bromide, potassium bromide and potassium iodide. In addition, there may also be used those as described in L. F. A. Menson, the 'Photographic Processing Chemistry,' p. 226–229, Focal Press (1966) U.S. Pat. Nos. 2,193,015 and 2,592,364; and JP O.P.I. No. 64933/1973. Of chelating agents used in order to hide the calcium ion present in city water that is used for preparing the developer solution, organic chelating agents are ones whose chelating stabilization constant with iron is not less than 8 as described in JP O.P.I. No. 193853/1989, while inorganic chelating agents include sodium hexametaphosphate, calcium hexametaphosphate and polyphosphates. As the hardener for the developer solution dialdehyde compounds may be used. In this instance, glutaraldehyde is preferred, provided, however, that for rapid processing, the hardener should be in advance incorporated into the light-sensitive material in its coating process rather than to be added to the developer solution.

The developing in the developer solution of the invention is made at a temperature of preferably 25° to 50° C., and more preferably 30° to 40° C. The developing time is preferably 5 to 90 seconds, and more preferably 8 to 60 seconds. The total processing time (dry to dry) is preferably 20 to 210 seconds, and more preferably 30 to 90 seconds.

The replenishment in the invention makes up for the loss of processing chemicals corresponding to their exhaustions caused by processing as well as by oxidation. The replenishing amount control may be made according to the width of or the transport speed of the film being processed as described in JP O.P.I. No. 126243/1980; according to the totalled area of processed films as described in JP O.P.I. No. 104946/1985; or according to the processed area derived from the number of continuously processed films as described in JP O.P.I. No. 149156/1989. The preferred replenishing amount is 500 to 150 ml/m$^2$.

The preferred fixing solution for the invention is one containing materials for fixation generally used by those in the art. The solution's pH is not less than 3.8, preferably 4.2 to 5.5.

The fixing agent used in the fixing solution is a thiosulfate such as ammonium thiosulfate or sodium thiosulfate; of these the particularly preferred is ammonium thiosulfate from the fixing speed point of view. The concentration range of ammonium thiosulfate is preferably 0.1 to 5 mol, more preferably 0.8 to 3 mol per liter of a fixing solution.

The fixing solution of the invention may be an acid hardening fixer. In this instance, as the hardener an aluminum ion is preferably used for example, preferably added in the form of aluminum sulfate, aluminum chloride or potassium alum.

In addition, the fixing solution of the invention may, if necessary, contain a preservative such as a sulfite or a hydrogensulfite; a pH buffer such as acetic acid or boric acid; various acids including a mineral acid such as sulfuric acid or nitric acid, an organic acid such as citric acid, oxalic acid or malic acid, or hydrochloric acid; a metallic hydroxide for pH adjustment such as potassium hydroxide or sodium hydroxide; and a chelating agent having a water-softening capacity.

The useful as the fixing accelerator for the fixing solution of the invention is one of compounds including the thiourea derivatives described in JP E.P. Nos. 35754/1970, 122535/1983 and 122536/1983; and the thioether compounds described in U.S. Pat. No. 4,126,459.

EXAMPLES

Examples of the invention are illustrated in detail, but the invention is not restricted by the examples.

Example 1

Preparation of Seed Emulsion-1

Seed Emulsion-1 was preprared as follows.

| | |
|---|---|
| Solution A1: | |
| Osein gelatin | 24.2 g |
| Water | 9657 ml |
| Sodium polypropyleneoxy-polyethylene-oxy-disuccinate (10% ethanol/aqueous solution) | 6.78 ml |
| Potassium bromide | 10.8 g |
| 10% nitric acid | 114 ml |
| Solution B1: | |
| 2.5N aqueous silver nitrate solution | 2825 ml |
| Solution C1: | |
| Potassium bromide | 824 g |
| Potassium iodide | 23.5 g |
| Water to make | 2825 ml |
| Solution D1: | |
| 1.75N aqueous potassium bromide solution | Amount necessary for the following Ag potential control |

A mixing/stirring device of the type described in JP E.P. Nos. 58288/1983 and 58289/1983 was used to make nucleus formation by adding 464.3 ml each of Solutions B1 and C1, spending 1.5 minutes, to Solution A1 at 42° C. according to the double-jet precipitation process.

After stopping the addition of Solutions B1 and C1, the temperature of Solution A1 was raised to 60° C. spending 60 minutes, pH of it was adjusted with 3% KOH to 5.0, and then Solutions B1 and C1 were again added according to the double-jet process at a flow rate of 55.4 ml/min spending 42 minutes. The silver potential (measured with a silver ion selection electrode, using a saturated silver-silver chloride electrode as a reference electrode) while the temperature was raised from 42° C. to 600° C. and while the resumed double-jet addition of Solutions B1 and C1 was in progress was controlled with use of Solution D1 so as to be +8 mv and +16 mv, respectively.

After completion of the addition, pH was adjusted with 3% KOH to 6, and the reaction product was immediately desalted and washed. The produced seed grain emulsion was confirmed by observation under an electron microscope that it comprises hexagonal tabular grains of which 90% or more of the overall projection area have a maximum adjacent side ratio of 1.0 to 2.0; an average grain thickness of 0.06 μm; and an average grain diameter (in terms of a circle diameter) of 0.59 μm. The variation coefficient of the grain thicknesses was 40%, and that of the distances between twin planes was 42%.

Preparation of Emulsion Em-1

A tabular grain emulsion having a core/shell-type structure was prepared by using the above Seed Emulsion-1 and the following 4 different solutions.

| | |
|---|---|
| Solution A2: | |
| Osein gelatin | 11.7 g |
| Sodium polypropyleneoxy-polyethylene-oxy-di-succinate (10% ethanol aqueous Solution) | 1.4 ml |
| Seed Emulsion-1 | equivalent to 0.10 mol |
| Water to make | 550 ml |

-continued

| | |
|---|---|
| Solution B2: | |
| Osein gelatin | 5.9 g |
| Potassium bromide | 4.6 g |
| Potassium iodide | 3.0 g |
| Water to make | 145 ml |
| Solution C2: | |
| Silver nitrate | 10.1 g |
| Water to make | 145 ml |
| Solution D2: | |
| Osein gelatin | 6.1 g |
| Potassium bromide | 94 g |
| Water to make | 304 ml |
| Solution E1: | |
| Silver nitrate | 137 g |
| Water to make | 304 ml |

To Solution A2, which was being vigorously stirred, Solutions B2 and C2 were added in 58 minutes according to the double-jet precipitation process, and then to the same solution were added Solutions D2 and E1 in 48 minutes by the double-jet process. In the above duration, pH and pAg were maintained at 5.8 and 8.7, respectively.

After completion of the addition, pH was adjusted with 3% KOH solution to 6, and immediately the reaction product was desalted and washed, whereby an emulsion having pAg 8.5 and pH 5.85 at 40° C. and having an average silver iodide content of about 2.0 mol % was obtained.

As a result of observing the obtained emulsion through an electron microscope, it was found that the emulsion was of tabular silver halide grains of which 81% or more of the projection area were grains having an average grain diameter of 0.96 μm; a grain diameter distribution broadness of 18%; an average aspect ratio of 4.5; and being comprised of double twinned crystals. The average of the distances(a) between twin planes of the above grains was 0.007 μm, and the variation coefficient of (a) was 45%.

Subsequently, the thus obtained silver halide emulsion was used to examine the effect of the invention.

In order to evaluate both the effect of adding the spectral sensitizer in the form of a methanol solution and the effect of adding the same in the form of a solid particulate dispersion, the emulsion Em-1 was subjected to spectral sensitization and to chemical sensitization in accordance with the following two different prescriptions. It was found that the resulting emulsion grains of each had a surface silver halide phase containing 4.0 mol % iodide. Prescription A:

To the emulsion at 60° C. were added methanol solutions of spectral sensitizers I-56 and II-2, and then added an aqueous solution of a mixture of ammonium thiocyanate, chloroauric acid and sodium thiosulfate, and a fine-grained silver iodide emulsion, thereby subjecting the emulsion to two-hour chemical ripening treatment. Upon completion of the chemical ripening, to the emulsion was added a stabilizer, 4-hydroxy-6-methyl-1,3,3a,7-tetrazaindene (TAI).

Prescription B:

The same prescription as the above prescription A except that the spectral sensitizer was added in the form of a solid particulate dispersion instead of adding in the form of a methanol solution. This dispersion was prepared in accordance with the method described in Japanese Patent Application No. 499437/1992; i.e., prepared by adding specified amounts of Sensitizers I-56 and II-2 to water warmed at 27° C. beforehand, and by stirring this over a period of 30 to 120 minutes by means of a high-speed stirrer 'Dissolver' at 3,500 rpm.

The amounts of the above additives added are as follows:

| | |
|---|---|
| Spectral sensitizer I-56 | 4 mg/mol Ag |
| Spectral sensitizer II-2 | 410 mg |
| Potassium thiocyanate | 95 mg |
| Chloroauric acid | 2.5 mg |
| Sodium thiosulfate | 2.5 mg |
| Fine-grained silver iodide | 850 mg |
| Stabilizer (TAI) | 1 g |

The adding amounts of the spectral sensitizers I-56 and II-2 in the case of adding in the form of a solid particle dispersion were varied.

Next, the thus sensitized emulsion, after adding the hereinafter described additives thereto, was used as an emulsion coating liquor.

The coating of the emulsion was made on a support by using a slide hopper-type coater so that the coated weight of silver was 2.0 g/m$^2$ and that of gelatin 3.1 g/m$^2$, whereby a dry sample was obtained. The support used was a polyethylene terephthalate film base for X-ray film use having a thickness of 175 μm, being blue-tinted to a density of 0.15, and having both sides thereof subbed with a copolymer aqueous dispersion obtained by diluting into a concentration of 10 wt % a copolymer comprising 3 different monomers: glycidyl methacrylate 50 wt %, methyl methacrylate 10 wt % and butyl methacrylate 40 wt %.

The additives added to the emulsion are as follows, wherein each additive is shown in in amount per mol of silver halide.

| | |
|---|---|
| 1,1-Dimethylol-1-bromo-1-nitromethane | 70 mg |
| t-Butyl-catechol | 400 mg |
| Polyvinylpyrrolidone (MW = 10,000) | 1.0 g |
| Styrene-maleic anhydride copolymer | 2.5 g |
| Nitrophenyl-triphenylphosphonium chloride | 50 mg |
| Ammonium 1,3-dihydroxybenzene-4-sulfonate | 2.0 g |
| $C_4H_9OCH_2CH(OH)CH_2N(CH_2COOH)_2$ | 1.0 g |
| 1-Phenyl-5-mercaptotetrazole | 15 mg |
| 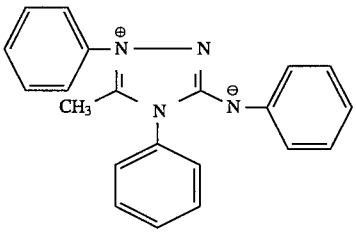 | 150 mg |
| 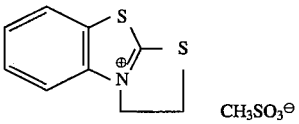 | 70 mg |
| Water-soluble dye 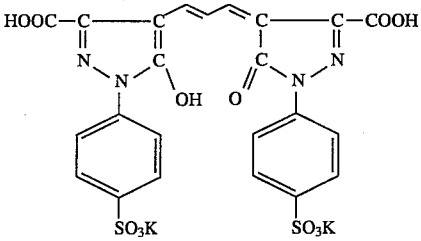 | |

Protective layer coating solution

A protective layer coating solution of the following composition was prepared, wherein each component is shown in an amount per liter of the solution.

| | |
|---|---|
| Lime-treated inert gelatin | 68 g |
| Acid-treated gelatin | 2.0 g |
| Sodium i-amyl-n-decylsulfosuccinate | 1.0 g |
| Polymethyl methacrylate (matting agent having an area average particle size of 3.5 μm) | 1.1 h |
| Silicon dioxide particles (matting agent having an area average particle size of 1.2 μm) | 0.5 g |
| $(CH_2{=}CHSO_2CH_2)_2$ (hardener) | 500 mg |
| $C_4F_9SO_3K$ | 2.0 mg |
| $C_{12}H_{25}CONH(CH_2CH_2O)_5H$ | 2.0 g |
| 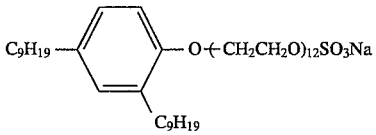 | 1.0 g |
| 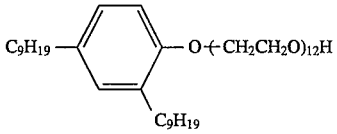 | 0.4 g |
| 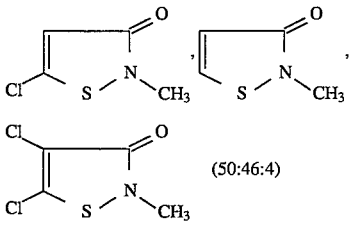 (50:46:4) | 0.1 g |

Besides, other samples were prepared by changing the kind of the spectral-sensitizing dye as shown in Table 2

TABLE 2

| Sample No. | Prescription | Kinds of dye and adding amount (total amount: mg/mol AgI) |
|---|---|---|
| 1 | A | I-56/II-2 = 44/371 (415) |
| 2 | B | I-56/II-2 = 27/223 (250) |
| 3 | B | I-56/II-2 = 30/250 (280) |
| 4 | A | I-4 /II-2 = 44/371 (415) |
| 5 | B | I-4 /II-2 = 30/250 (280) |
| 6 | A | I-16/II-2 = 44/371 (415) |
| 7 | B | I-16/II-2 = 30/250 (280) |

The relative speed, residual color density and reflection spectrum of each of the samples thus obtained were evaluated.

For evaluation, firstly, each sample was sandwiched by a pair of sheets of intensifying screen KO-250, manufactured by KONICA Corp., and then was exposed for 0.05 second through an aluminum step wedge to X-rays radiated under conditions of a tube voltage of 80 kvp and a tube potential of 100 mA. The exposed sample was then processed in developer and fixer baths of the following prescriptions by an automatic processor SRX-502, manufactured by KONICA Corp.

Developer:

Part-A (for making 12-liter working solution)

| | |
|---|---|
| Potassium hydroxide | 450 g |
| Potassium sulfite (50% solution) | 2280 g |
| Diethylenetetraminepentaacetic acid | 120 g |
| Sodium hydrogencarbonate | 132 g |

-continued

| | |
|---|---|
| 5-Methylbenzotriazole | 1.2 g |
| 1-Phenyl-5-mercaptotetrazole | 0.2 g |
| Hydroquinone | 340 g |
| Water to make | 5000 ml |
| Part-B (for making 12-liter working solution) | |
| Glacial acetic acid | 170 g |
| Triethylene glycol | 185 g |
| 1-Phenyl-3-pyrazolidone | 22 g |
| 5-nitroindazole | 0.4 g |
| Starter | |
| Glacial acetic acid | 120 g |
| Potassium bromide | 225 g |
| Water to make | 1.0 liter |
| Fixer | |
| Part-A (for making 18-liter working solution) | |
| Ammonium thiosulfate (70 wt/vol %) | 6000 g |
| Sodium sulfite | 110 g |
| Sodium acetate, trihydrate | 450 g |
| Sodium citrate | 50 g |
| Gluconic acid | 70 g |
| 1-(N,N-dimethylamino)ethyl-5-mercaptotetrazole | 18 g |
| Part-B | |
| Aluminum sulfate | 800 g |

For making a developer working solution, both Part-A and Part-B were added simultaneously to about 5 liters of water and dissoved with stirring, and to this was added water to make the whole 12 liters, and pH of it was adjusted with glacial acetic acid to 10.40.

To one liter of the above prepared developer were added 20 ml of the foregoing starter, pH was adjusted to 10.26, and this was used as a working solution.

For preparing a fixer solution, both Part-A and Part-B were added simultaneously to about 5 liters of water and dissolved with stirring, and to this was added water to make the whole 18 liters, and pH of it was adjusted with sulfuric acid or NaOH to 4.4; this was provided as a fixer replenisher.

Regarding the processing temperatures, developing was made at 5° C., Fixing at 33° C., washing at 20° C., and drying at 50° C. The overall dry-to-dry processing time was 45 seconds.

After processing, samples were subjected to sensitometry tests. The sensitivity of each sample was expressed as the reciprocal of the exposure amount necessary for giving a fog+0.5 density, and indicated in the following table as a relative speed to the speed of Sample No.1 set at 100.

Regarding the residual color stain, the specular transmission density in the fogged area of each processed sample was measured with a spectrophotometer U-3210, manufactured by Hitachi Ltd., and indicated in the following table with a relative density to the peak density of the residual dye remaining in the processed Sample No.1 set at 100, wherein the spectrophotometric measurement was made on each sample before being processed.

The obtained results are shown in the following table. The reflection spectra of Samples No.1 to No.3 are shown in FIG. 1.

TABLE 3

| Sample No. | Relative speed | Residual color |
|---|---|---|
| 1 | 100 | 100 |
| 2 | 115 | 55 |
| 3 | 125 | 62 |

TABLE 3-continued

| Sample No. | Relative speed | Residual color |
|---|---|---|
| 4 | 102 | 100 |
| 5 | 130 | 62 |
| 6 | 100 | 100 |
| 7 | 125 | 62 |

From the above results, it has been found that the addition of the sensitizing dyes in the form of solid particle dispersion, even in a small amount, enables to give unexpectedly better spectral absorption results, higher sensitivities and less residual color stains than in the form of methanol solutions. These effects were totally beyond expectations in the initial stage. In addition, even in other spectral sensitizers, regardless of whether used alone or in combination, similar solid particle dye dispersion results to those shown in the above were found.

Example 2

Preparation of Emulsion Em-2

Tabular pure silver bromide emulsion Em-2 was prepared in the same manner as in Em-1 except that the Solution B2 was replaced by Solution B3.

| Solution B3: | |
|---|---|
| Osein gelatin | 5.9 g |
| Potassium bromide | 6.75 g |
| Water to make | 145 ml |

The obtained emulsion was observed through an electron microscope. As a result, it was found that the emulsion was of tabular silver halide grains 81% of the projection area of which were grains having an average grain diameter of 0.97 μm, a grain diameter distribution broadness of 18%, and an average aspect ratio of 4.6. In addition, the grains were comprised of double twinned crystals and the average of the average distance(a) between twin planes was 0.007 μm, and the variation coefficient of (a) was 45%.

Emulsion samples were prepared in the same manner as in Em-1 and Em-2 except that the adding amount of fine-grained silver iodide in Sample No.1 (Prescription B) in Example 1 was changed to vary the iodide content of the grain surface, and each emulsion was coated on both sides of a support simultaneously by means of two slide hopper-type coaters so that the coating weight of silver was 2.0 g/m$^2$ per side and that of gelatin 3.1 g/m$^2$ per side, and then dried, whereby Samples No.8 to No.17 were obtained. The support used was a polyethylene terephthalate film base for radiographic use having a thickness of 175 μm and blue-tinted to have a density of 0.15, both sides of which are each subbed with a gelatin layer containing a copolymer aqueous dispersion obtained by diluting into 10 wt % the concentration of a copolymer comprised of 3 different monomers: glycidyl methacrylate 50 wt %, methyl methacrylate 10 wt % and butyl methacrylate 40 wt %. The prepared samples are shown in Table 4.

TABLE 4

| Sample No. | Emulsion | Iodide content (mol %) of grain surface after chemical ripening |
|---|---|---|
| 8 (Comp.) | Em-1 | 1.0 |

TABLE 4-continued

| Sample No. | Emulsion | Iodide content (mol %) of grain surface after chemical ripening |
|---|---|---|
| 9 (Inv.) | Em-1 | 4.0 |
| 10 (Inv.) | Em-1 | 10.0 |
| 11 (Inv.) | Em-1 | 15.0 |
| 12 (Comp.) | Em-1 | 25.0 |
| 13 (Comp.) | Em-2 | 1.0 |
| 14 (Inv.) | Em-2 | 4.0 |
| 15 (Inv.) | Em-2 | 10.0 |
| 16 (Inv.) | Em-2 | 15.0 |
| 17 (Comp.) | Em-2 | 25.0 |

The thus obtained Samples No.8 to No.17 were each allowed to stand over a period of 4 days under two different conditions (Condition C: 23° C./55% RH, Condition D: 40° C./80% RH), and after that, their photographic characteristics were evaluated. The results are shown in Table 3, in which the 22.5-second super-rapid processing was enabled by use of a modified automatic processor in combination with processing solutions which were made lower-replenishment-rate by altering their compositions. The performance of each sample was indicated as a relative value to that of Sample No.8 set at 100.

TABLE 5

| | Condition C Relative speed | | Condition D Desensitized range | Condition D sharpness |
|---|---|---|---|---|
| Sample No. | 45-sec. processing | 22.5-sec. processing | 45-sec. processing | 45-sec. processing |
| 8 | 100 | 100 | 100 | 100 |
| 9 | 140 | 150 | 60 | 115 |
| 10 | 145 | 158 | 50 | 120 |
| 11 | 145 | 125 | 70 | 125 |
| 12 | 85 | 70 | 120 | 120 |
| 13 | 85 | 85 | 110 | 100 |
| 14 | 120 | 128 | 70 | 115 |
| 15 | 123 | 135 | 60 | 120 |
| 16 | 120 | 105 | 80 | 125 |
| 17 | 72 | 60 | 140 | 120 |

In Table 5, as for the relative speed, the larger the value, the higher the sensitivity, and as to the desensitized range, the smaller the value, the smaller the sensitization degree is to make the photographic performance stable. And as for the sharpness, the larger the value, the higher the sharpness is to give an excellent image quality.

From the results shown in Table 5 it is well understood that each light-sensitive material sample of the invention still has a high sensitivity even when subjected to a super-high-speed processing, and its sensitivity is little deteriorated and still excellent in the image sharpness even when stored under high-moisture conditions. If the iodide content of the grain surface exceeds the limits specified in the invention, the sharpness and the desensitization degree under high moisture conditions are relatively satisfactory probably because the adsorption force of the spectral sensitizer gets strengthed, but the sensitivity is lowered, particularly significant when the processing time is shortened, while if the iodide content is small to the contrary, any of the characteristics evaluated in Example 2 becomes lowered probably because the adsorption force of the spectral-sensitizing dye is weakened.

Example 3

Preparation of Emulsion-3

To a solution of 6 g of potassium bromide and 7 g of gelatin dissolved in one liter of water kept at 55° C. in a vessel were added 37 ml of an aqueous silver nitrate solution containing 4.0 g of silver nitrate and 38 ml of aqueous potassium bromide solution containing 5.9 g of potassium bromide in 37 seconds by a double-jet precipitation process. Next, after adding 18.6 g of gelatin thereto, the reaction system was heated to a temperature of 70° C. and to this were added 89 ml of an aqueous silver nitrate solution containing 9.8 g of silver nitrate, spending 22 minutes. Hereupon, 7 ml of an aqueous 25% ammonia solution were added, and the emulsion was subjected to physical ripening for 10 minutes at the temperature remaining intact, and then to this were added 6.5 ml of 100% acetic acid, followed by adding an aqueous solution of 153 g of silver nitrate and an aqueous potassium bromide solution with pAg kept at 8.5, spending 35 minutes, by the double-jet precipitation process. Then a potassium thiocyanate solution was added. After 5-minute physical ripening of the emulsion at the temperature remaining intanct, the emulsion was cooled to 35° C., whereby monodisperse tabular pure silver bromide grains having an average grain diameter of 1.10 μm, an average grain thickness of 0.165 μm, and diameters' variation coefficient of 18.5% were obtained. The average of the distances(a) between twin planes of the grains was 0.00 μm, and the variation coefficient thereof was 25%.

Samples No.18 to No.22 were prepared in the same manner as Example 2 except that the emulsions used in the Samples No.13 to No.17 of Example 2 were subjected to selenium sensitization (N,N-dimethylselenourea 0.4 mg/mol Ag) and the following water-soluble dye was incorporated in the form of a solid particle dispersion into the subbing layer of the support.

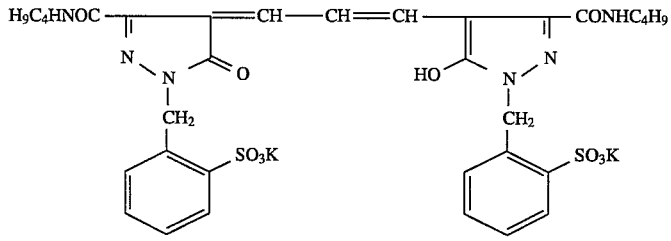

Further, Sample No.23 also was prepared for comparison in the same manner as in Sample No.20 except that its grain to be chemically sensitized was replaced by Emulsion-3.

TABLE 6

| Sample No. | Emulsion | Iodide content (mol %) of grain surface after chemical ripening |
|---|---|---|
| 18 | Em-2 | 1.0 |
| 19 | Em-2 | 4.0 |
| 20 | Em-2 | 10.0 |
| 21 | Em-2 | 15.0 |
| 22 | Em-2 | 25.0 |
| 23 | Em-3 | 4.0 |

In the evaluation items of these samples, the super-rapid/ultra-low-replenishment-rate processing characteristics of the samples stored under high-moisture conditions were added to the characteristics seen in Example 2 in order to ascertain the effect of the invention. The results are as shown in Table 7.

TABLE 7

| | Condition A | | Condition B | | |
|---|---|---|---|---|---|
| | Relative speed | | Desensitization degree | | Sharpness |
| Sample No. | 45-sec. processing | 22.5-sec. processing | 45-sec. processing | 22.5-sec. processing | 45-sec. processing |
| 18 | 100 | 100 | 100 | 100 | 100 |
| 19 | 130 | 140 | 65 | 60 | 115 |
| 20 | 135 | 145 | 55 | 50 | 120 |
| 21 | 115 | 135 | 75 | 70 | 125 |
| 22 | 90 | 80 | 120 | 120 | 120 |
| 23 | 150 | 160 | 55 | 50 | 135 |

As is apparent from Table 7, the samples having the iodide content of the grain surface within the invention, even when subjected to the selenium sensitization, show remarkable effects, while the grain having an aspect ratio of 8 shows a slight but further effect.

What is claimed is:

1. A silver halide photographic light-sensitive material comprising a support having provided thereon hydrophilic colloid layers including a silver halide emulsion layer containing a silver halide emulsion, wherein said silver halide emulsion comprises tabular grains having an average aspect ratio of diameter to thickness of 2 or more, containing, on average, 2 mol % or less iodide, said grains having a surface phase containing, on average, 3 to 20 mol % iodide;

said emulsion being spectrally sensitized by adding a sensitizing dye represented by the following Formula [I] or [II] in the form of solid particles dispersed in an aqueous medium substantially free from organic solvent and surfactant;

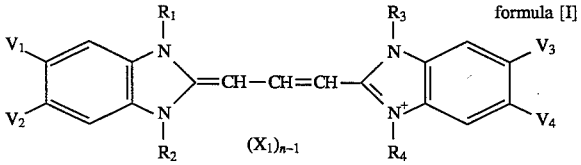

wherein $R_1$ and $R_3$ independently represent a substituted or unsubstituted alkyl group; $R_2$ and $R_4$ independently represents an lower alkyl group, provided that at least one of $R_2$ and $R_4$ is an alkyl group substituted by a hydrophilic group; $V_1$, $V_2$, $V_3$ and $V_4$ independently represent a hydrogen atom or a substituent, provided that the sum of Hammett's σp values of $V_1$, $V_2$, $V_3$ and $V_4$ is not more than 1.7; $X_1$ represents an ion; and n is 1 or 2,

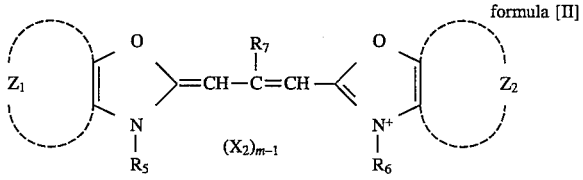

wherein $R_5$ an $R_6$ independently represent a substituted or unsubstituted alkyl group, a substituted or unsubstituted alkenyl group or a substituted or unsubstituted aryl group, provided that at least one of $R_5$ and $R_6$ is a sulfoalkyl or carboxyalkyl group; $R_7$ represents a hydrogen atom, an alkyl group or an aryl group; $Z_1$ and $Z_2$ represent non-metal atomic group necessary or forming a benzene or naphthalene ring, which may be substituted; $X_2$ represents an ion; and m is 1 or 2.

2. The photographic material of claim 1, wherein said silver halide emulsion is spectrally sensitized by adding both a sensitizing dye of formula [I] and sensitizing dye of formula [II].

3. The photographic material of claim 1, wherein said emulsion is chemically sensitized by adding thereto at least one of a selenium compound, a tellurium compound and a reductive compound.

4. The photographic material of claim 1, wherein said silver halide grains have two or more parallel twin planes in the grain, said grains having a (b/a) ratio of 5 or more and accounting for 50% or more of total grains by number, in which (a) is the longest distance between two or more parallel twin planes and (b) is the grain thickness.

5. The photographic material of claim 1, wherein at least one of the hydrophilic colloid layers contains a dye represented by the following formulas [1] through [6],

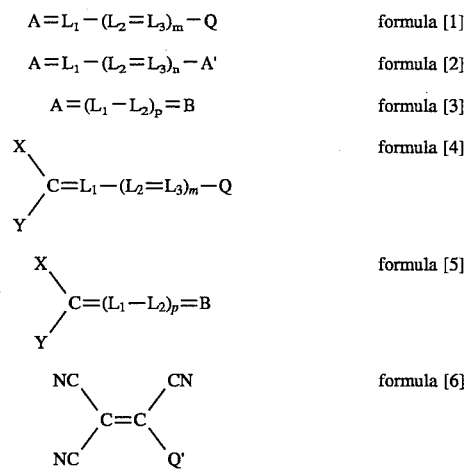

wherein A and A' independently represent an acidic nucleus; B represents a basic nucleus; Q represents an aryl group or a heterocyclic group; Q' represents a heterocyclic group; X and Y independently represent an electron-attractive group; $L_1$, $L_2$ and $L_3$ represent a methine group; m is 0 or 1; n is 0, 1 or 2; p is 0 or 1, provided that each of the dyes of formulas [1] through [6] has at least one selected from a carboxy group, a sulfonamide group and a sulfamoyl group.

6. The photographic material of claim 5, wherein said dye is in the form of a dispersion of solid particles dispersed in a binder.

7. A silver halide photographic light-sensitive material comprising a support having thereon hydrophilic colloid layers including a silver halide emulsion layer comprising silver halide emulsion, wherein said silver halide emulsion comprises tabular grains having an average aspect ratio of diameter to thickness of 2 or more, containing 2 mol % or less iodide on the average, and having a surface silver halide phase containing 3 to 20 mol % iodide on the average;

said emulsion is chemically sensitized by adding thereto at least one of a selenium compound, a tellurium compound and a reductive compound; and said emulsion is spectrally sensitized by adding a sensitizing dye represented by the following formula [I] or [II] in the form of solid particles dispersed in an aqueous medium substantially free from an organic solvent and a surfactant, formula [I]

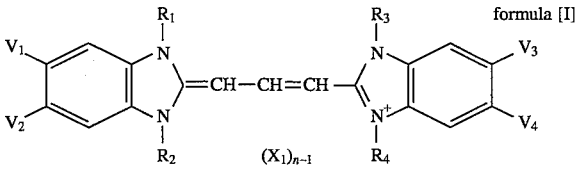

wherein $R_1$ and $R_3$ independently represent a substituted or unsubstituted alkyl group; $R_2$ and $R_4$ independently represents an lower alkyl group, provided that at least one of $R_2$ and $R_4$ is an alkyl group substituted by a hydrophilic group; $V_1$, $V_2$, $V_3$ and $V_4$ independently represent a hydrogen atom or a substituent, provided that the sum of Hammett's σp values of $V_1$, $V_2$, $V_3$ and $V_4$ is not more than 1.7; $X_1$ represents an ion; and n is 1 or 2, formula [II]

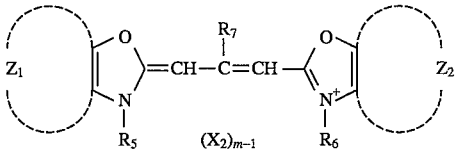

wherein $R_5$ and $R_6$ independently represent a substituted or unsubstituted alkyl group, a substituted or unsubstituted alkenyl group or a substituted or unsubstituted aryl group, provided that at least one of $R_5$ and $R_6$ is a sulfoalkyl or carboxyalkyl group; $R_7$ represents a hydrogen atom, an alkyl group or an aryl group; $Z_1$ and $Z_2$ represent non-metal atomic group necessary for forming a benzene or naphthalene ring, which may be substituted; $X_2$ represents an ion; and m is 1 or 2.

* * * * *